US010173872B2

(12) United States Patent
Decker

(10) Patent No.: US 10,173,872 B2
(45) Date of Patent: Jan. 8, 2019

(54) PORTABLE SELF-LOCKING LIFT SYSTEM

(71) Applicant: Actuant Corporation, Menomonee Falls, WI (US)

(72) Inventor: Arnold Decker, Aurora, IL (US)

(73) Assignee: Actuant Corporation, Menomonee Falls, WI (US)

( * ) Notice: Subject to any disclaimer, the term of this patent is extended or adjusted under 35 U.S.C. 154(b) by 0 days.

(21) Appl. No.: 14/856,681

(22) Filed: Sep. 17, 2015

(65) Prior Publication Data

US 2016/0075540 A1 Mar. 17, 2016

Related U.S. Application Data

(60) Provisional application No. 62/051,607, filed on Sep. 17, 2014.

(51) Int. Cl.
*B66F 3/00* (2006.01)
*B66F 3/30* (2006.01)
(Continued)

(52) U.S. Cl.
CPC ..... *B66F 3/30* (2013.01); *B66F 3/08* (2013.01); *B66F 3/24* (2013.01)

(58) Field of Classification Search
CPC .... B66F 3/30; B66F 17/00; B66F 1/02; B66F 1/025; B66F 1/00; F15B 15/26; F15B 15/28
See application file for complete search history.

(56) References Cited

U.S. PATENT DOCUMENTS 1,709,000 A 4/1929 Bolens
2,412,414 A 12/1946 Mueller
(Continued)

FOREIGN PATENT DOCUMENTS

CN 2488681 5/2002
CN 101464124 6/2009
(Continued)

OTHER PUBLICATIONS

ENERPAC, Synchronous Lift Systems, 03-0399708-484, US, 2008, 8 pages.
(Continued)

*Primary Examiner* — Tyrone V Hall, Jr.
(74) *Attorney, Agent, or Firm* — Michael Best & Friedrich LLP

(57) ABSTRACT

A lift system includes a cylinder having an end surface, a threaded member supported for movement with a piston, and a nut threadedly engaging the threaded member and selectively engageable with the end surface. Engagement of the nut and the end surface limits axial movement of the piston relative to the cylinder in at least one direction. A drive mechanism rotates the nut relative to the threaded member, and a control valve controls movement of the piston relative to the cylinder. A drive control mechanism controls operation of the drive mechanism and rotation of the nut. A nut sensor senses a portion of the nut. The nut sensor is in communication with at least one of the control valve and the drive control mechanism. When the nut sensor detects a portion of the nut, the control valve stops movement of the piston or the drive control mechanism stops rotation of the nut.

20 Claims, 40 Drawing Sheets

(51) Int. Cl.
*B66F 3/24* (2006.01)
*B66F 3/08* (2006.01)

(56) References Cited

U.S. PATENT DOCUMENTS

| | | | | | |
|---|---|---|---|---|---|
| 3,236,489 | A * | 2/1966 | Mattocks | B63C 5/04 | 254/103 |
| 3,309,062 | A * | 3/1967 | Jansz | B66F 3/30 | 254/93 VA |
| D225,431 | S | 12/1972 | Gulotta | | |
| 4,359,206 | A * | 11/1982 | McCreery | B66F 3/30 | 254/93 R |
| 4,481,864 | A * | 11/1984 | Peruzzi | B66F 3/30 | 188/82.2 |
| 4,557,709 | A * | 12/1985 | St. John | F16H 7/1218 | 474/117 |
| D287,207 | S | 12/1986 | Daenen et al. | | |
| 4,767,383 | A * | 8/1988 | St. John | F16H 7/1281 | 474/111 |
| 4,865,293 | A | 9/1989 | Ishi et al. | | |
| 4,886,244 | A | 12/1989 | Renault | | |
| 5,000,424 | A * | 3/1991 | Inoue | B66F 5/04 | 254/93 H |
| 5,048,794 | A | 9/1991 | Mamessier | | |
| 5,524,868 | A | 6/1996 | Decker et al. | | |
| 5,681,029 | A | 10/1997 | Reesor et al. | | |
| 5,691,894 | A * | 11/1997 | Fukushima | F15B 15/262 | 700/28 |
| 6,302,249 | B1 * | 10/2001 | Jolly | F15B 11/076 | 188/269 |
| 6,321,611 | B1 * | 11/2001 | Szu | F16H 25/2015 | 192/141 |
| D468,965 | S | 1/2003 | Fino et al. | | |
| D483,222 | S | 12/2003 | Willis | | |
| D538,583 | S | 3/2007 | Schuler | | |
| 7,343,846 | B2 | 3/2008 | Stanford et al. | | |
| D574,661 | S | 8/2008 | Logan | | |
| 7,479,078 | B2 * | 1/2009 | Joslyn | F16H 7/1281 | 474/117 |
| D689,731 | S | 9/2013 | Dorion | | |
| D711,191 | S | 8/2014 | Lee | | |
| 9,574,613 | B1 * | 2/2017 | Youngers | F16D 1/00 | |
| 2002/0079481 | A1 | 6/2002 | Oxtoby | | |
| 2008/0173013 | A1 | 7/2008 | Hernandez et al. | | |
| 2008/0277204 | A1 * | 11/2008 | Moller | B66F 3/24 | 187/247 |
| 2010/0051885 | A1 * | 3/2010 | Davis | B66F 7/14 | 254/92 |
| 2013/0269511 | A1 * | 10/2013 | Lemke | B66F 3/30 | 91/55 |
| 2015/0076432 | A1 * | 3/2015 | Farquharson | B66F 3/24 | 254/93 A |

FOREIGN PATENT DOCUMENTS

| | | | |
|---|---|---|---|
| FR | 2857000 | | 1/2005 |
| JP | S50-84969 | | 7/1975 |
| JP | 3003896 | | 1/1991 |
| JP | H05-37891 | | 5/1993 |
| JP | H0537891 | * | 5/1993 |
| JP | 3590662 | | 11/2004 |
| WO | 2012088019 | | 6/2012 |

OTHER PUBLICATIONS

PCT International Search Report and Written Opinion for Application No. PCT/US2011/065994 dated Mar. 30, 2012 (13 pages).
First Office Action and Search Report of The State Intellectual Property office of The People's Republic of China for Application No. 201180062211.2 dated Dec. 22, 2014 (13 pages).
First Office Action from the Australian Intellectual Property Office for Application No. 2011349408 dated Oct. 15, 2015 (3 pages).
PCT/US2015/043873 International Search Report and Written Opinion dated Jan. 14, 2016 (19 pages).

* cited by examiner

NUT POSITION TO SENSORS DURING RAISE

NUT POSITION TO SENSORS DURING LOWER

SWIVEL CAP ON TOP OF PLUNGER

SWIVEL CAP WITH EXTENSION ON TOP OF PLUNGER

SWIVEL CAP WITH EXTENSION ADAPTER ON TOP OF PLUNGER

*Retraction*

PORTABLE SELF-LOCKING LIFT SYSTEM

CROSS-REFERENCE TO RELATED APPLICATION

This application claims the benefit of prior-filed, U.S. Provisional Patent Application No. 62/051,607, filed Sep. 17, 2014, the entire contents of which is incorporated herein by reference.

FIELD

The present invention relates to lift systems and to methods of using the same.

SUMMARY

Fluid lift systems (e.g., those incorporating hydraulic cylinders or hydraulic jacks) may be used for lifting or lowering large loads (e.g., bridges, structures, machinery, vehicles, rail cars, large equipment, etc.) for a variety of reasons (e.g., performing maintenance on the load, repositioning the load, etc.). For some large loads, multiple hydraulic cylinders may be employed to provide the necessary force and balance to lift the load. Often, fluid cylinders are used both as a lifting mechanism and as a support member once a load is lifted. For example, large machinery may require maintenance and a technician may need to access the machinery from below in order to complete the necessary task. After lifting the machinery, the fluid cylinders may further support it while the technician services the machinery from below.

In addition to creating a unsecure situation for the user, such a system risks damage to the load and objects in the lift area while the load is being lifted and lowered because a rapid loss of pressure (e.g., due to a failure in a hydraulic cylinder, a conduit, a hydraulic pump, etc.) may result in the load being dropped. Existing lift systems may include a manually-turned lock nut which is positioned after a load is fully lifted or fully lowered to act as a stop feature. However, such a mechanism does not secure the load during the lifting or lowering processes. Also, manual operation of the lock nut after lifting is completed and/or before lowering the load is inefficient and can be especially time-consuming when multiple cylinders are used to lift a load. A user may also be in an insecure position at least partially underneath the load to adjust the lock mechanism.

In one independent aspect, a lift system includes a cylinder having an end surface, a piston movably supported in the cylinder, and a threaded member supported for movement with the piston. The lift system further includes a nut threadedly engaging the threaded member and selectively engageable with the end surface, and engagement of the nut and the end surface limits axial movement of the piston relative to the cylinder in at least one direction. The lift system further includes a drive mechanism operable to rotate the nut relative to the threaded member, a control valve operable to control movement of the piston relative to the cylinder, a drive control mechanism operable to control operation of the drive mechanism and rotation of the nut, and a nut sensor operable to sense a portion of the nut. The nut sensor is in communication with at least one of the control valve and the drive control mechanism. When the nut sensor detects a portion of the nut, the control valve stops movement of the piston or the drive control mechanism stops rotation of the nut.

In another independent aspect, a lift system includes a cylinder having an end surface and extending along a cylinder axis, a piston supported for movement relative to the cylinder along the cylinder axis, a threaded member supported for movement with the piston, and a nut threadedly engaging the threaded member. At least a portion of the nut is selectively engageable with the end surface. Engagement of the nut and the end surface limits movement of the piston relative to the cylinder along the cylinder axis in at least one direction. The lift system further includes a sensor assembly operable to sense a position of the nut relative to the end surface, the sensor assembly being supported for movement relative to the cylinder in a direction transverse to the cylinder axis.

In yet another independent aspect, a lift system includes a cylinder having an end surface, a piston supported for movement relative to the cylinder, a threaded member supported for movement with the piston and defining an axis, a nut threadedly engaging the threaded member and selectively engageable with the end surface, and a drive mechanism operable to rotatably drive the nut. Engagement of the nut and the end surface limits axial movement of the piston relative to the cylinder in at least one direction. The drive mechanism includes a motor including a drive member supported in axially fixed relation to the cylinder, and a flexible member drivingly connecting the drive member to the nut. Rotation of the drive member causes rotation of the nut, and rotation of the nut causes axial movement of the nut along the threaded member.

In still another independent aspect, a method of operating a lift system, the lift system including a cylinder having an end surface, a piston movably supported in the cylinder, a threaded member supported for movement with the piston, a nut threadedly engaging the threaded member, and a drive mechanism operable to rotatably drive the nut, the method including: supplying fluid to the cylinder to extend the piston relative to the cylinder; operating the drive mechanism to rotate the nut and selectively maintain the nut engaged with the end surface, engagement of the nut and the end surface limiting axial movement of the piston relative to the cylinder in a retraction direction; and retracting the piston relative to the cylinder, retracting including supplying fluid to the cylinder to extend the piston relative to the cylinder to disengage the nut from the end surface, and operating the drive mechanism to disengage the nut from the end surface.

In yet another independent aspect, a lift system for supporting a load above a work surface includes a cylinder having a first end and a second end, a piston movably supported in the cylinder, and a base plate including a lower surface supportable on the work surface and an upper surface connected to the first end of the cylinder. The base plate has a peripheral edge, a central portion, and a tapered portion therebetween. The central portion has a first thickness and the peripheral edge has a second thickness, the first thickness being greater than the second thickness.

In still another aspect, a lift system includes a cylinder, a piston movably supported in the cylinder and having an upper end, and an extension assembly operable to extend a length of the piston. The extension assembly includes a first extension member selectively connected directly to the upper end of the piston and having a first length, and a second extension member selectively and alternatively connectable directly to the top end of the piston and to the first extension member. The second extension member has a second length different than the first length, wherein the second extension member cannot be coupled the first extension member such that the second extension member is positioned between the first extension member and the upper end of the piston.

Independent features and independent advantages of the invention may become apparent to those skilled in the art upon review of the detailed description, drawings and claims.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

The use of "including", "comprising", or "having" and variations thereof herein is meant to encompass the items listed thereafter and equivalents thereof as well as additional items. Unless specified or limited otherwise, the terms "mounted", "connected", "supported", and "coupled" and variations thereof are used broadly and encompass both direct and indirect mountings, connections, supports, and couplings. Further, "connected" and "coupled" are not restricted to physical or mechanical connections or couplings.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components may be utilized to implement the invention. For example, "servers" and "computing devices" described in the specification can include one or more processing units, one or more computer-readable medium modules, one or more input/output interfaces, and various connections (e.g., a system bus) connecting the components.

Figure 1:
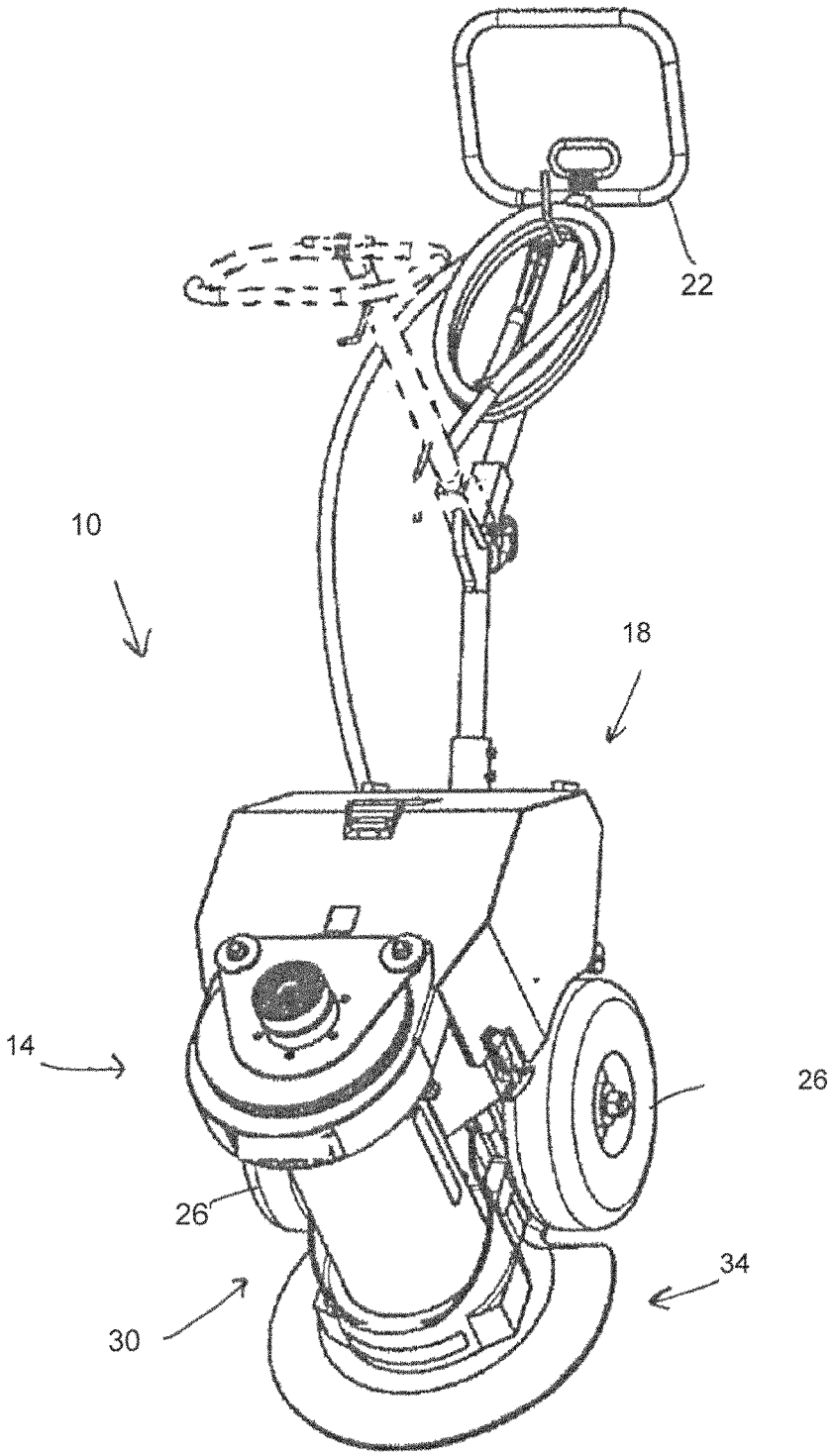
FIG. 1 is a perspective view of a lift system.
Figure 2:
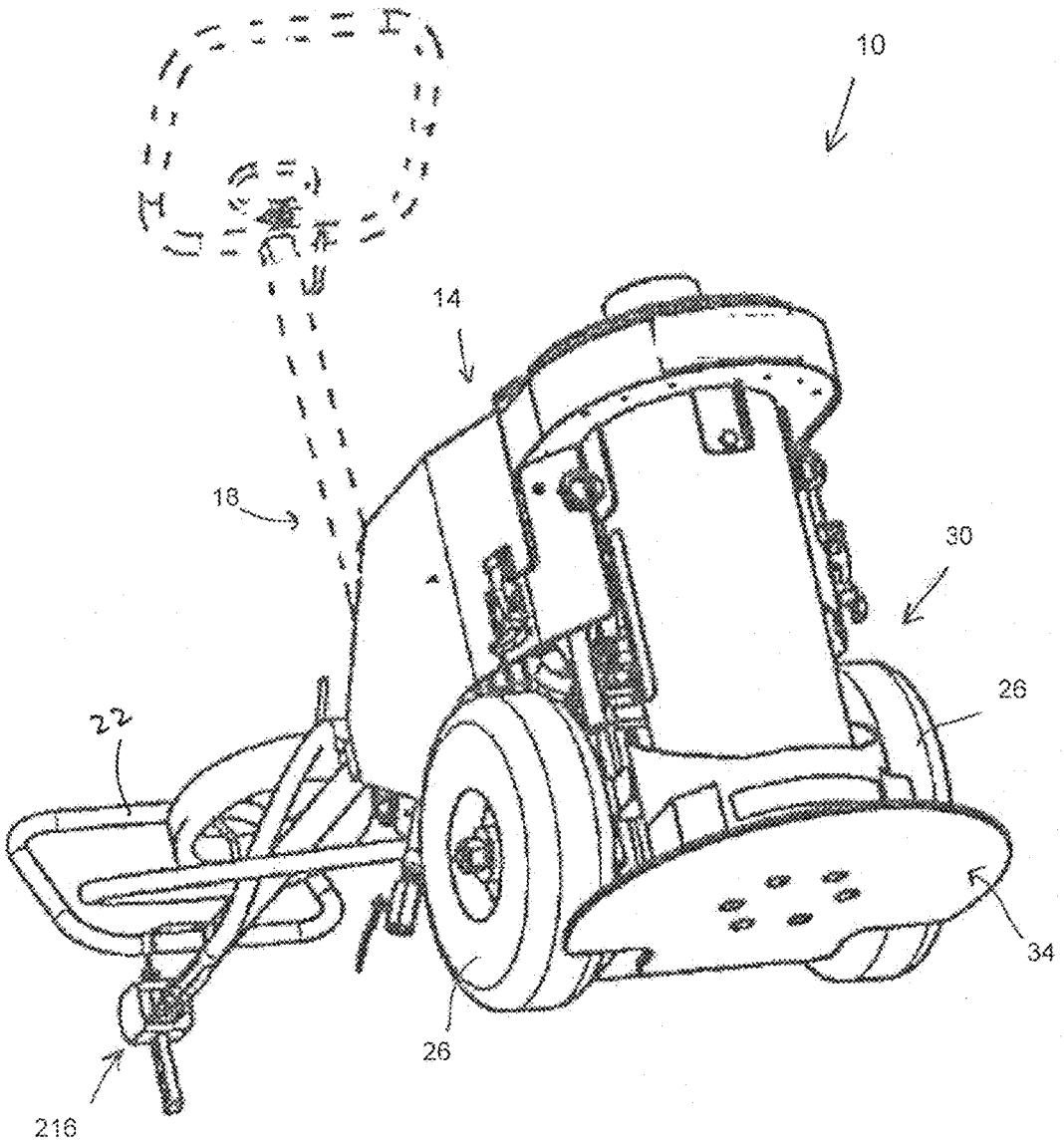
FIG. 2 is another perspective view of the lift system of FIG. 1.
Figure 3:
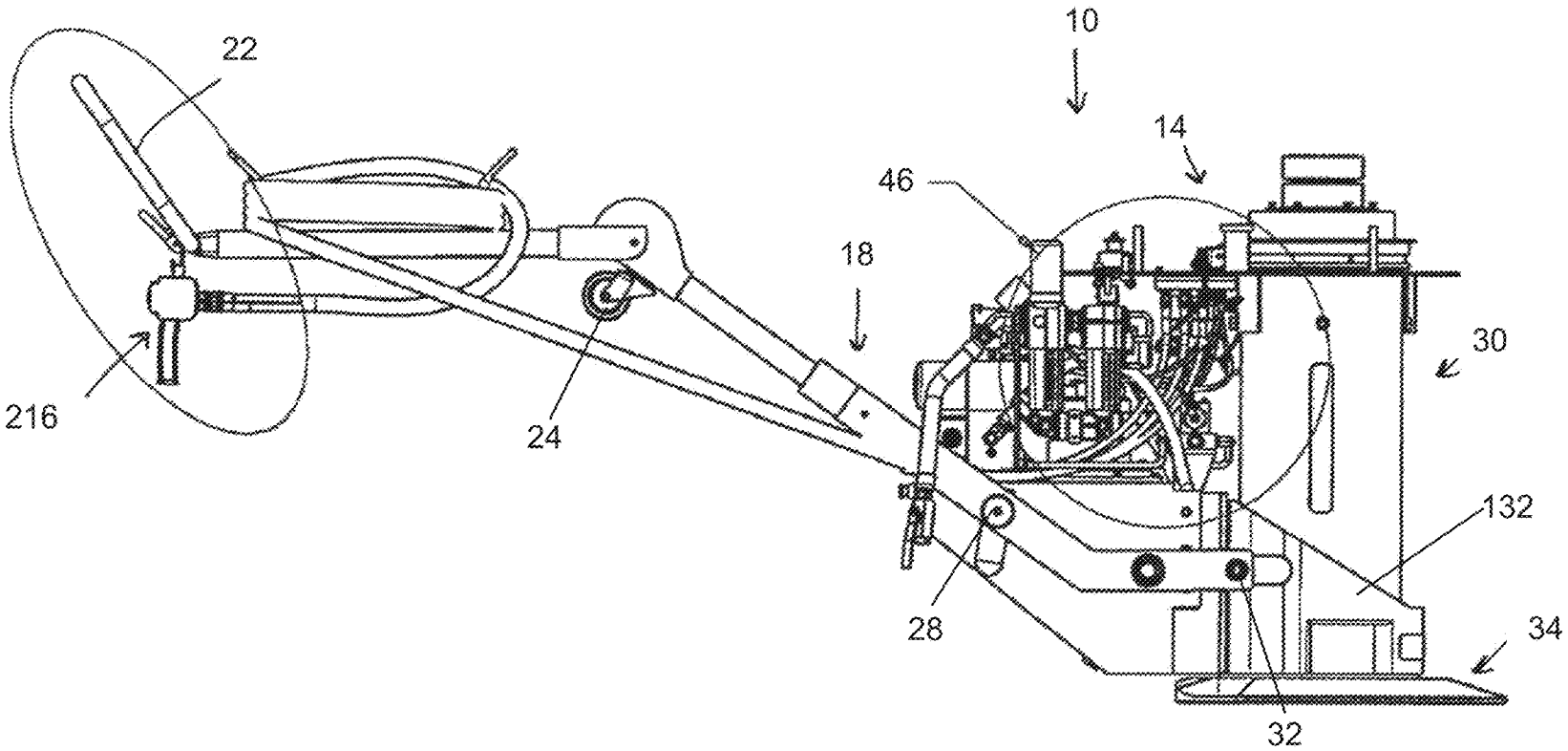
FIG. 3 is a side view of the lift system of FIG. 1.
Figure 4:
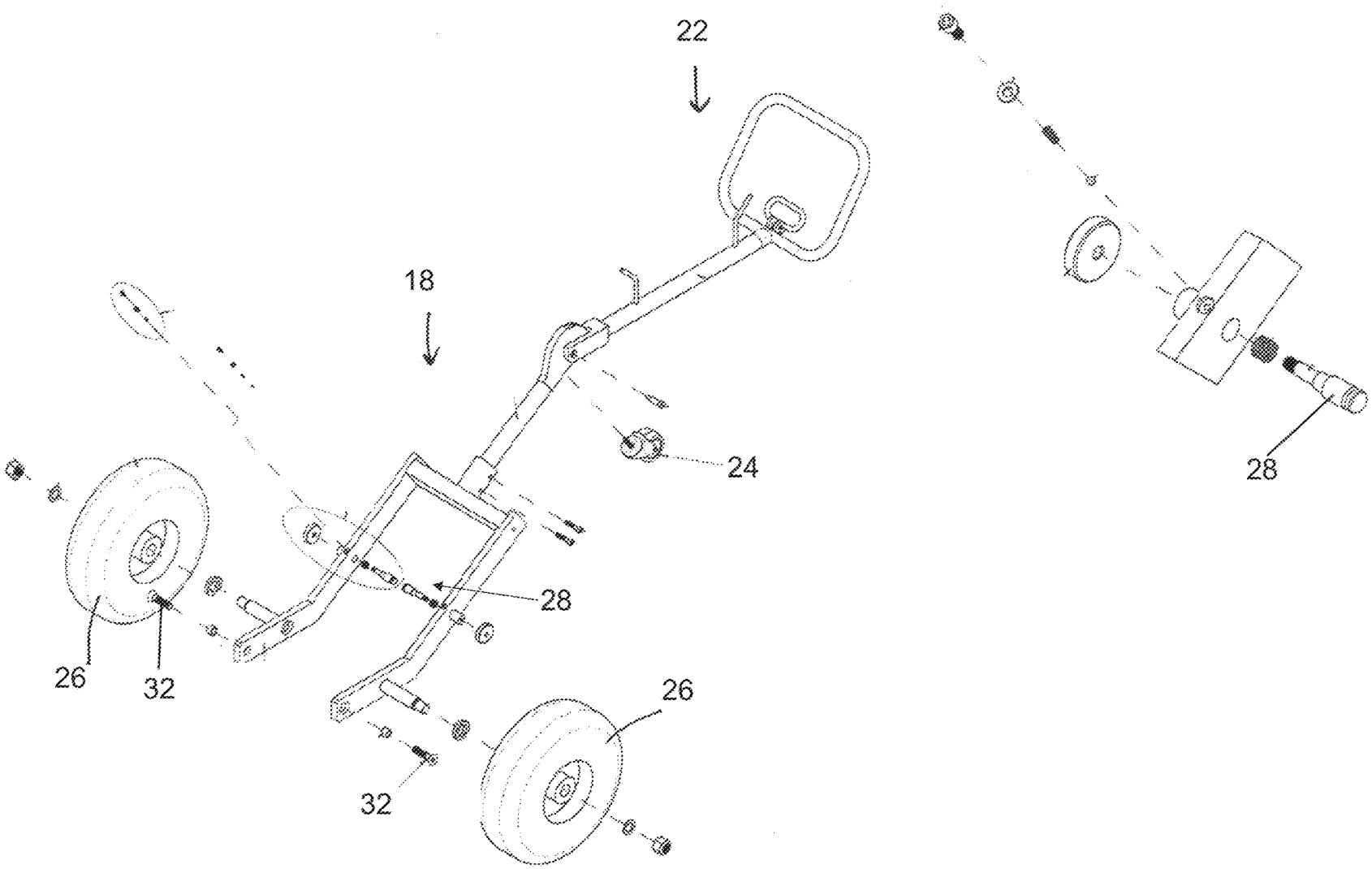
FIG. 4 is an exploded view of a frame for the lift system of FIG. 1.

FIGS. 1-3 illustrate a portable lift system 10 including a housing 14 supported on a frame 18. As shown in FIGS. 3 and 4, the frame 18 includes a movable handle 22 and is supported for movement by wheels 26 to aid a user in maneuvering and controlling the lift system 10. The frame 18 further includes a third wheel or caster 24 for engaging the ground when the system 10 is rotated about the axle of the wheels 26. In addition, the handle 22 is pivotable between a lower position and an upper position, both of which are illustrated in FIGS. 1-2. The handle 22 is releasably retained in at least these positions by a retainer mechanism (e.g., a locking pin, a clamp, etc.).

As shown in FIGS. 3 and 4, the frame 18 includes lock pins 28 that releasably engage a portion of the housing 14 (FIG. 3) or a reservoir 184 (see below) to maintain the frame 18 in a locked position. The frame 18 further includes pins 32 that are pivotably coupled to a sleeve 132 (FIG. 3) supporting the actuator assembly 30. In the illustrated embodiment, the pins 32 are coupled to the sleeve 132 at a position behind the center of gravity of the actuator assembly 30 (FIG. 3). When the lock pins 28 are disengaged, the frame 18 is able to pivot at the pins 32.

When a downward force is exerted on the handle 22, the force induces a moment at the axle of the wheels 26 to rotate the actuator assembly 30 about the axle of the wheels 26. Because the center of gravity of the actuator assembly 30 is "outside" and forward of the pin connection 32, the upper end of the actuator assembly 30 rotates away from the wheels 26 as the pin connection 32 is raised. This tipping of the actuator assembly 30 reduces the surface contact and weight on the floor and creates a three-point contact between the floor and the jack: the first point-of-contact is the front edge of the base 34, and the other two points-of-contact are at each wheel 26. The three-point contact facilitates easier movement of the system 10 without significant upward displacement of the actuator assembly 30, thereby allowing for easier alignment of the actuator assembly 30 to the desired lifting point under the load.

Figure 5:
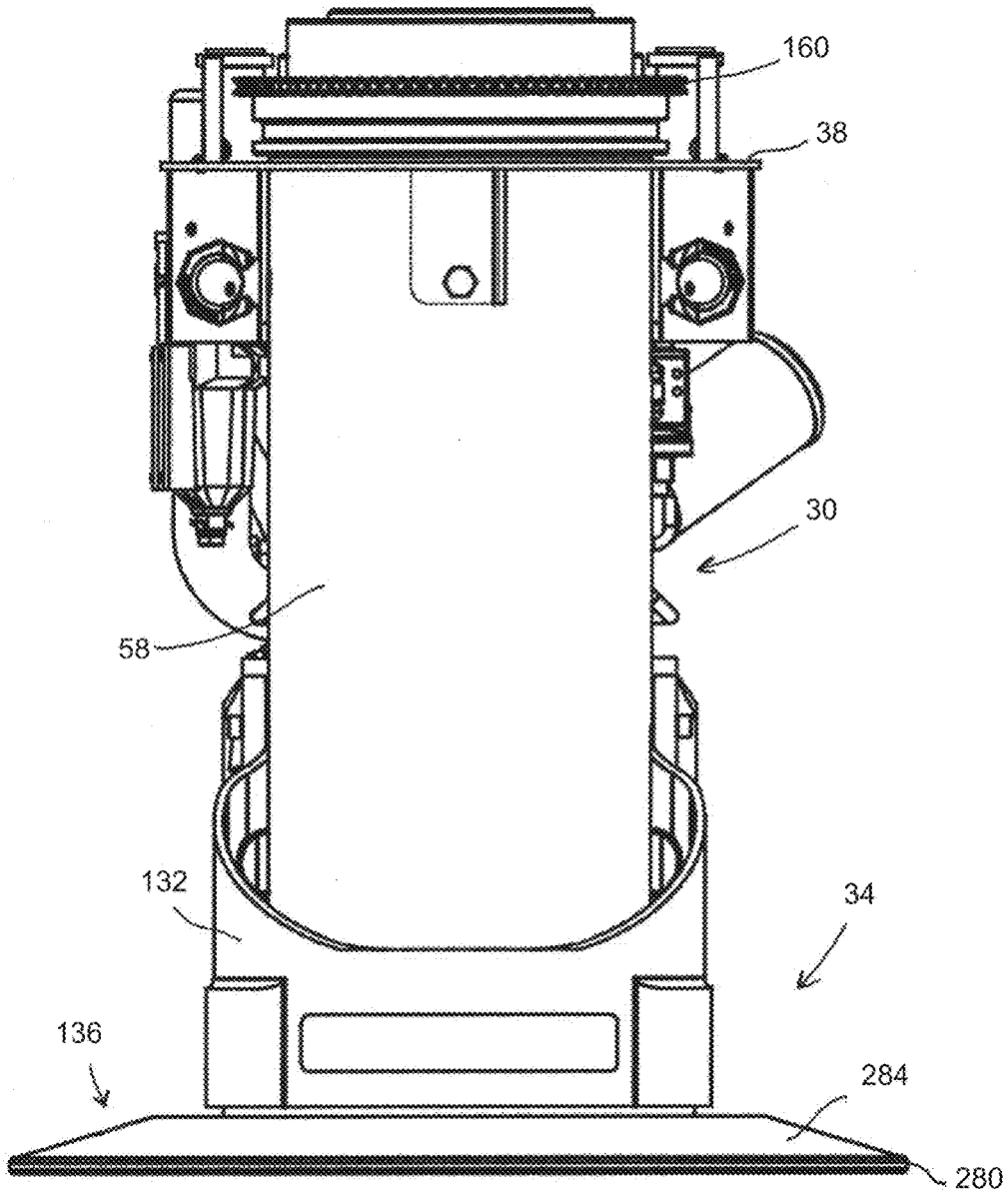
FIG. 5 is a front view of a portion of the lift system of FIG. 1.
Figure 6:
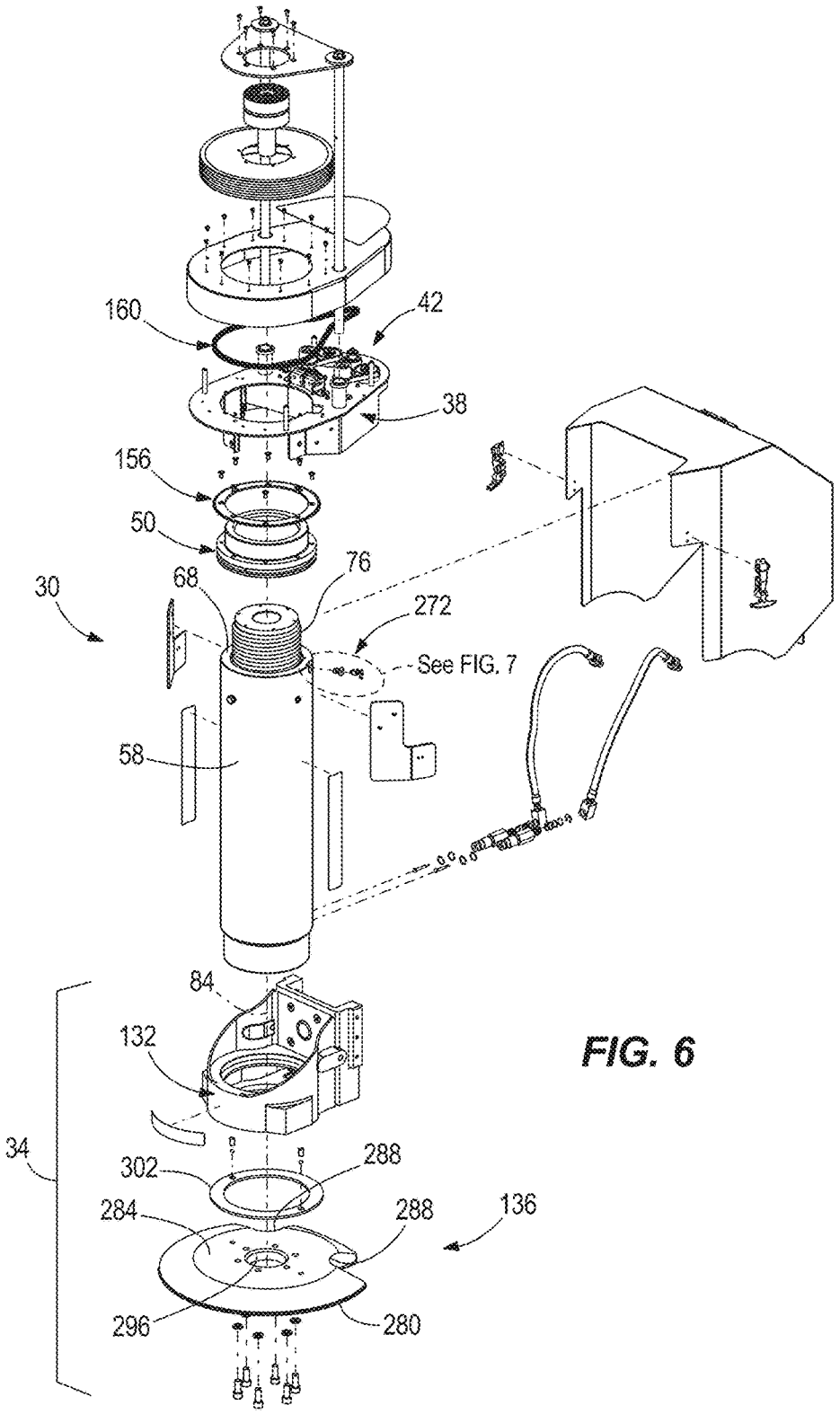
FIG. 6 is an exploded view of the portion of the lift system shown in FIG. 5.
Figure 7:
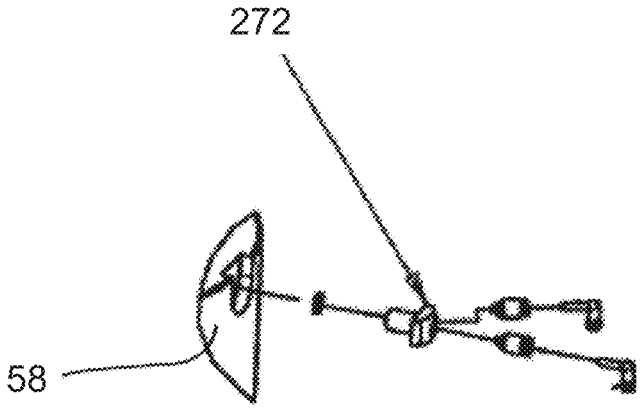
FIG. 7 is an enlarged perspective view of a portion of a sensor.

As shown in FIGS. 5-7, the housing 14 supports an actuator assembly 30 (e.g., a hydraulic cylinder assembly) and includes a base 34 and a cover plate 38. The housing 14 also supports a drive assembly 42 and a logic control system 46 (FIG. 3). As discussed in detail below, the actuator assembly 30 is extendable to lift a load, and the drive assembly 42 is controlled to rotate a lock nut 50 as the actuator assembly 30 is extended or retracted to maintain the lock nut 50 against a support surface and, thereby, limit or prevent unwanted movement of (e.g., dropping) the load, for example, in case of a sudden loss of fluid pressure.

Referring to FIG. 6, the actuator assembly 30 is supported by the base 34, which includes a sleeve 132 extending around a portion of the actuator assembly 30 and a foot member 136. The top end 68 of the actuator assembly 30 is positioned proximate the cover plate 38.

Figure 8:
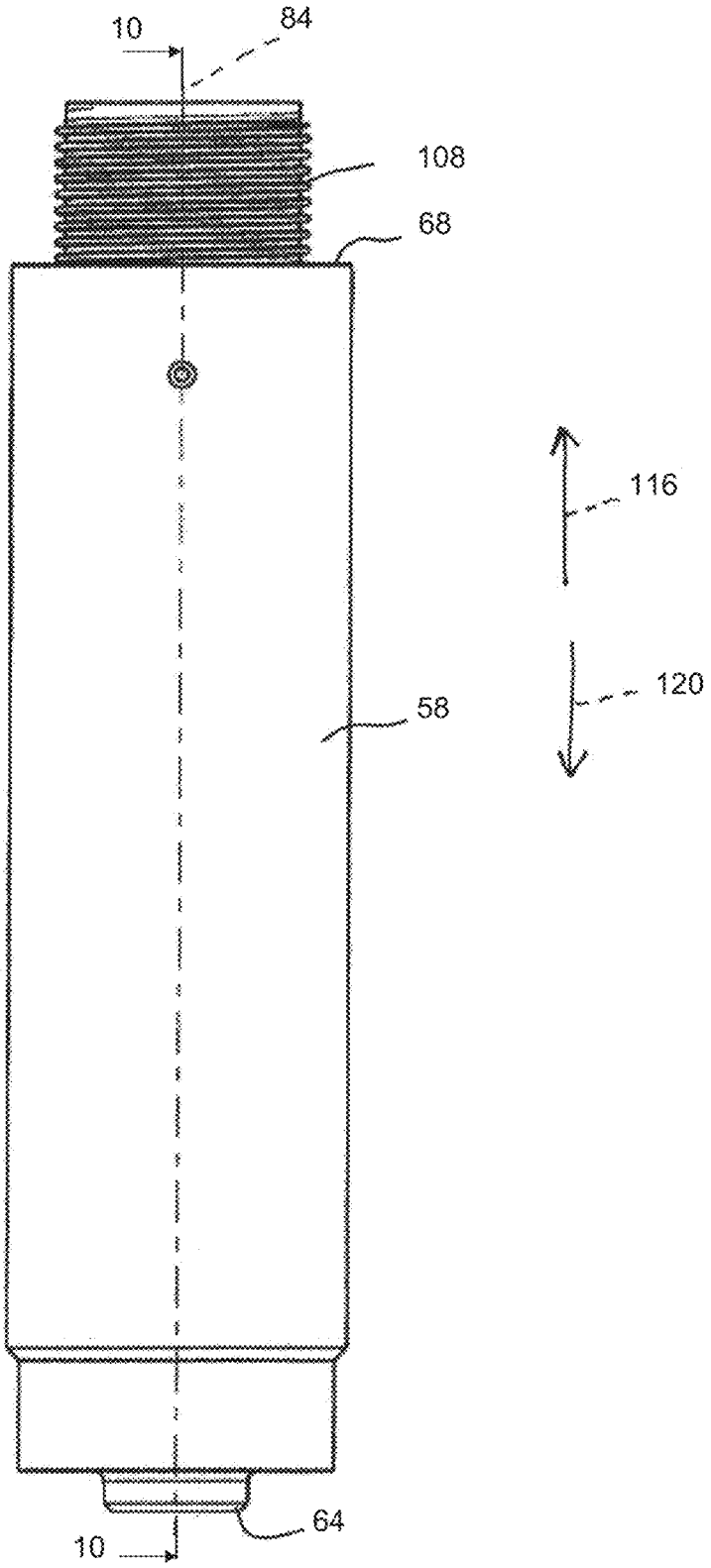
FIG. 8 is a side view of an actuator assembly.
Figure 9:
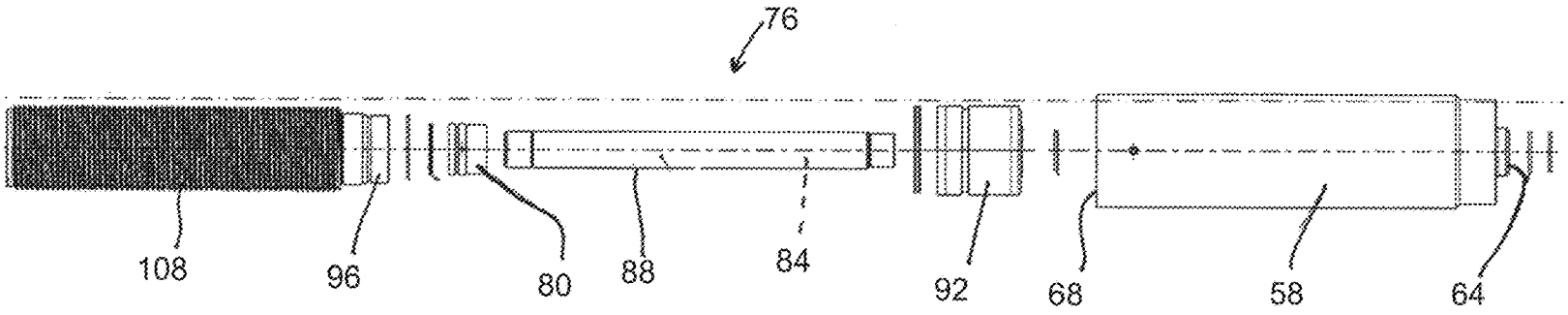
FIG. 9 is an exploded side view of the actuator assembly shown in FIG. 8.
Figure 10:
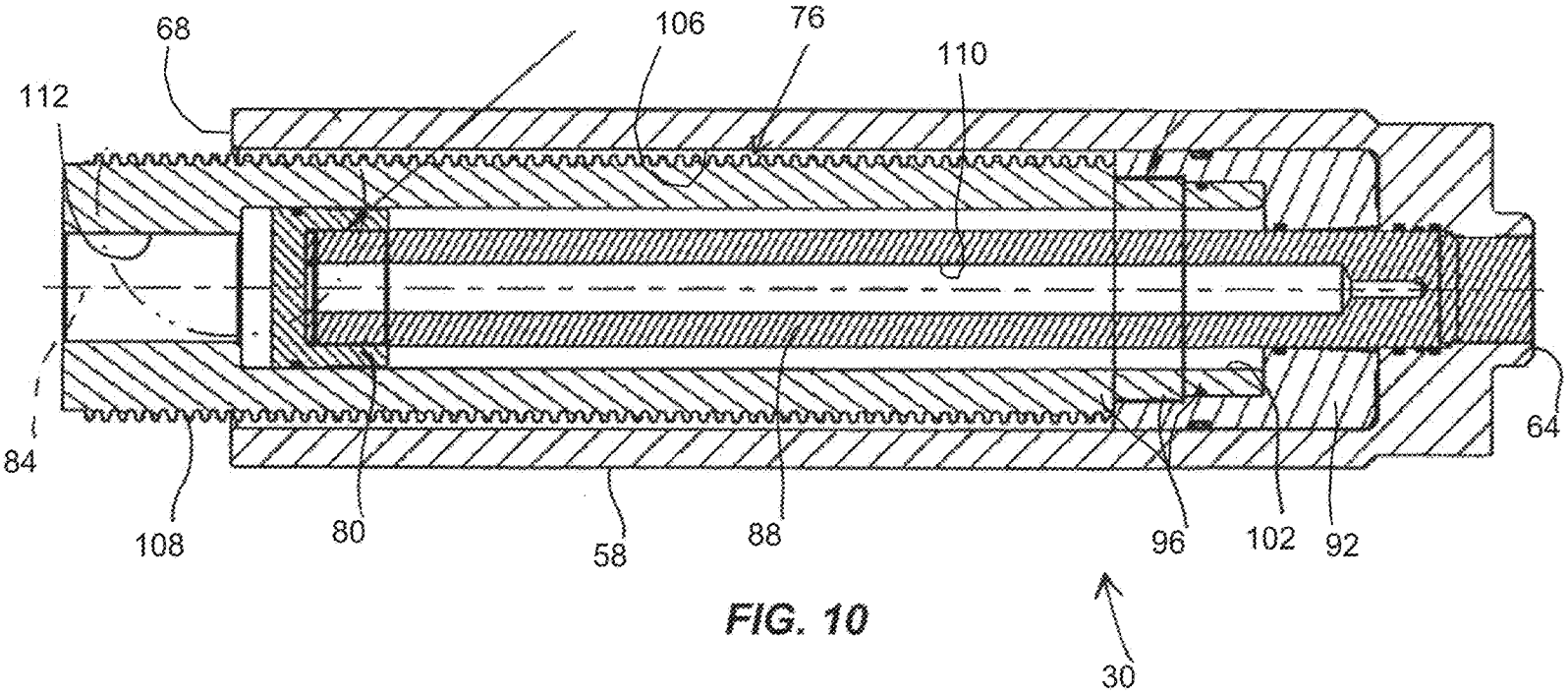
FIG. 10 is a cross-sectional view of the actuator assembly taken generally along line 10-10 in FIG. 8.

Referring to FIGS. 8-10, the actuator assembly 30 includes a cylinder 58 having a bottom end 64 and a top end 68. The actuator assembly 30 further includes a threaded plunger or ram 76 and a double acting piston 80. A longitudinal axis 84 extends between the ends 64, 68 of the cylinder 58.

As best shown in FIG. 10, the ram 76 includes a stem 88, a lower portion 92, and an upper portion 96. The stem 88 is coupled to the double acting piston 80, and both are positioned in an inner bore 102 extending axially through the ram 76. A portion of the stem 88 extends through the lower portion 92 and is secured to the cylinder 58. The piston 80 is sealed against the inner bore 102. The upper portion 96 has external threads 108 extending through the top end 68. The ram 76 receives the double acting piston 80 and stem 88 and is disposed in a bore 106 of the cylinder 58.

In the illustrated embodiment, pressurized fluid is supplied to the bore 106 between the lower portion 92 and the end of the cylinder 58, thereby extending the ram 76 relative to the cylinder 58. To retract the ram 76, fluid is supplied to the chamber defined between the inner bore 102 and the stem 88 and between the piston 80 and the lower portion 92. In one embodiment, the pressurized fluid for retracting the ram 76 is conveyed through a passage 110 within the stem 88. In the illustrated embodiment, the ram 76 also includes another bore 112 proximate the end of the ram 76, e.g., for coupling the ram 76 to a member for engaging the load.

The ram 76 moves axially in an extension direction 116 (FIG. 8) and an opposite retraction direction 120 (FIG. 8) when pressurized fluid is supplied to the actuator assembly 30. The lock nut 50 (FIG. 6) is threadably coupled to the external threads 108 of the ram 76. This threaded engagement allows the lock nut 50 to move axially along to the ram 76 as the ram 76 is extended or retracted, and this axial movement allows the lock nut 50 to stay in position or move with respect to the end surface 68 (e.g., the top of the cylinder 58) as the ram 76 is extended or retracted.

As shown in FIGS. 11-15, the cover plate 38 supports the drive assembly 42 and the logic control system 46. The drive assembly 42 maintains a lock nut 50 in engagement against an axially-fixed surface (e.g., a top end 68 of the cylinder 58 in the illustrated construction). The components of the drive assembly 42 are similar to the system described in U.S. Patent Application Publication No. US 2013/0269511 A1, published Oct. 17, 2013, the entire contents of which are hereby incorporated by reference.

Figure 11:
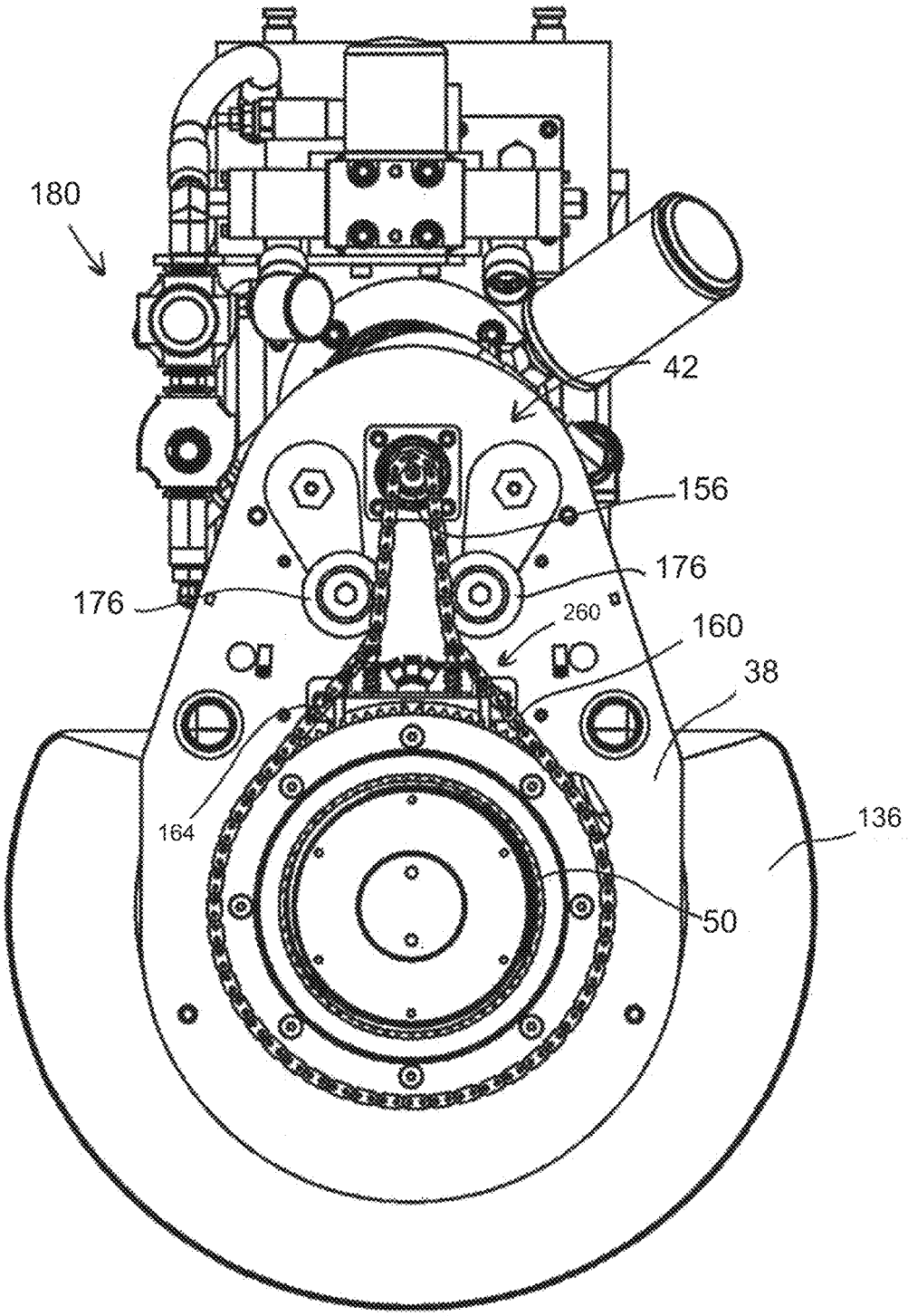
FIG. 11 is a top view of the portion of the lift system shown in FIG. 5.
Figure 12:
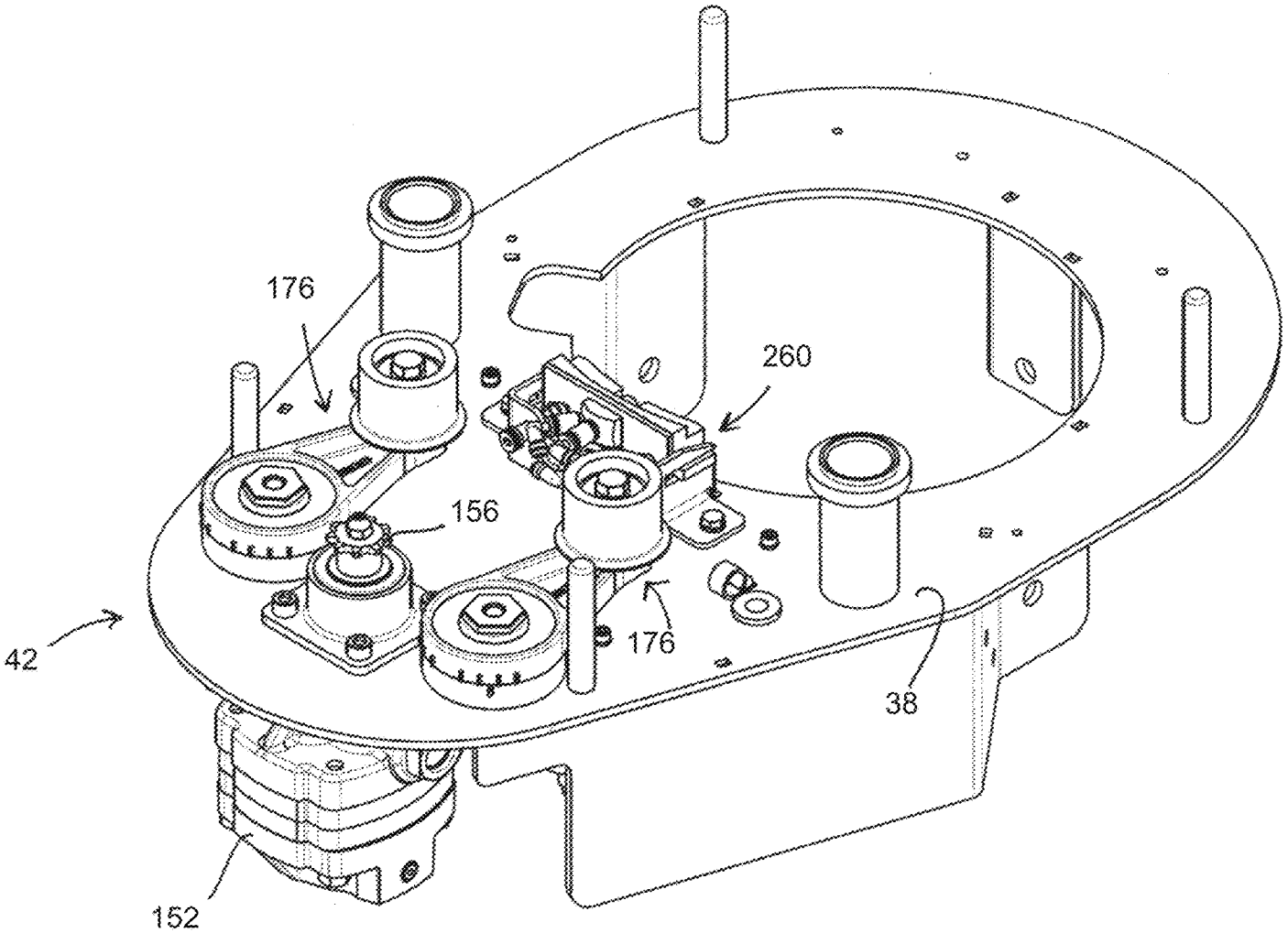
FIG. 12 is a perspective view of a support structure and a drive mechanism.
Figure 13:
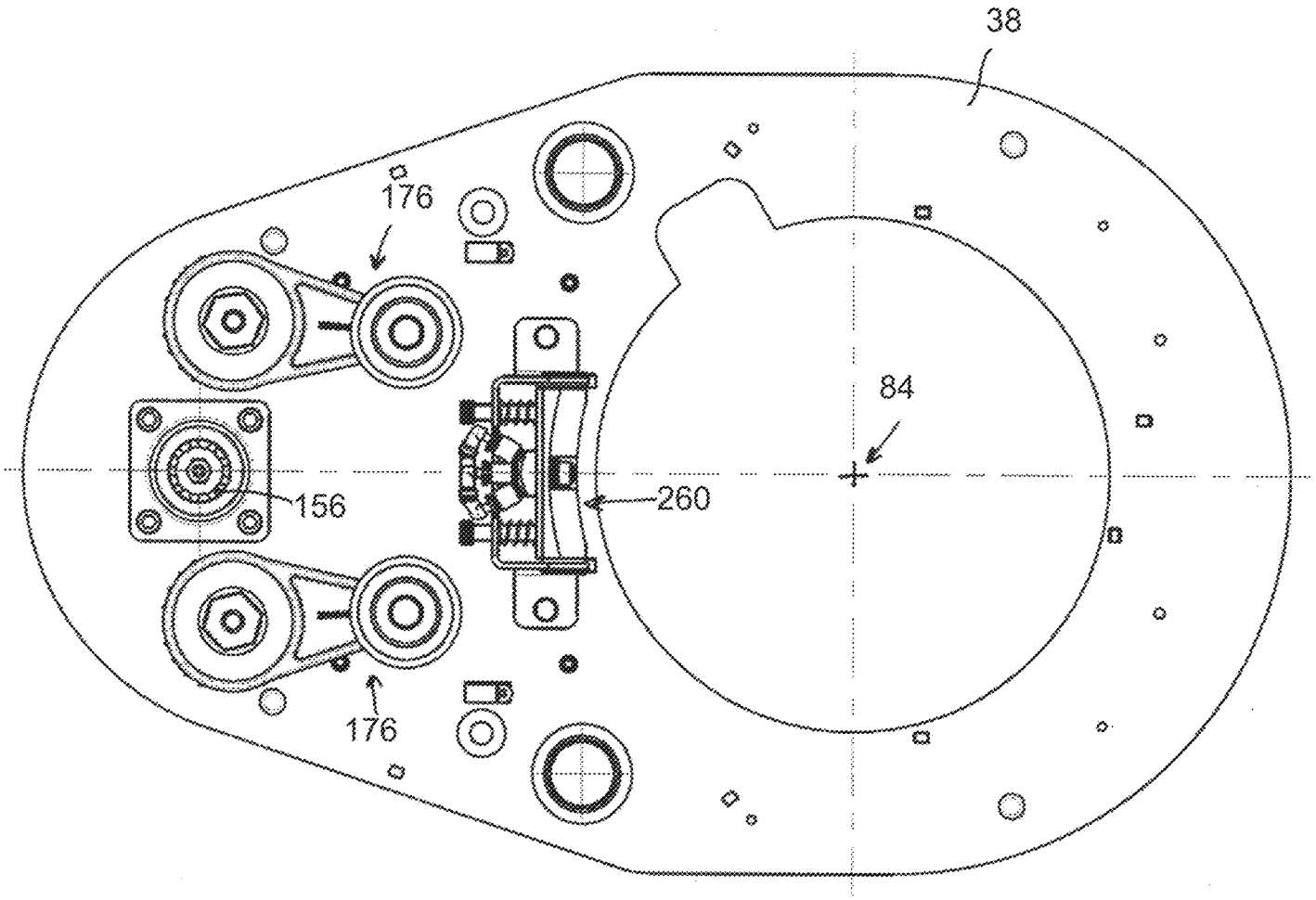
FIG. 13 is a top view of the structure shown in FIG. 12.
Figure 14:
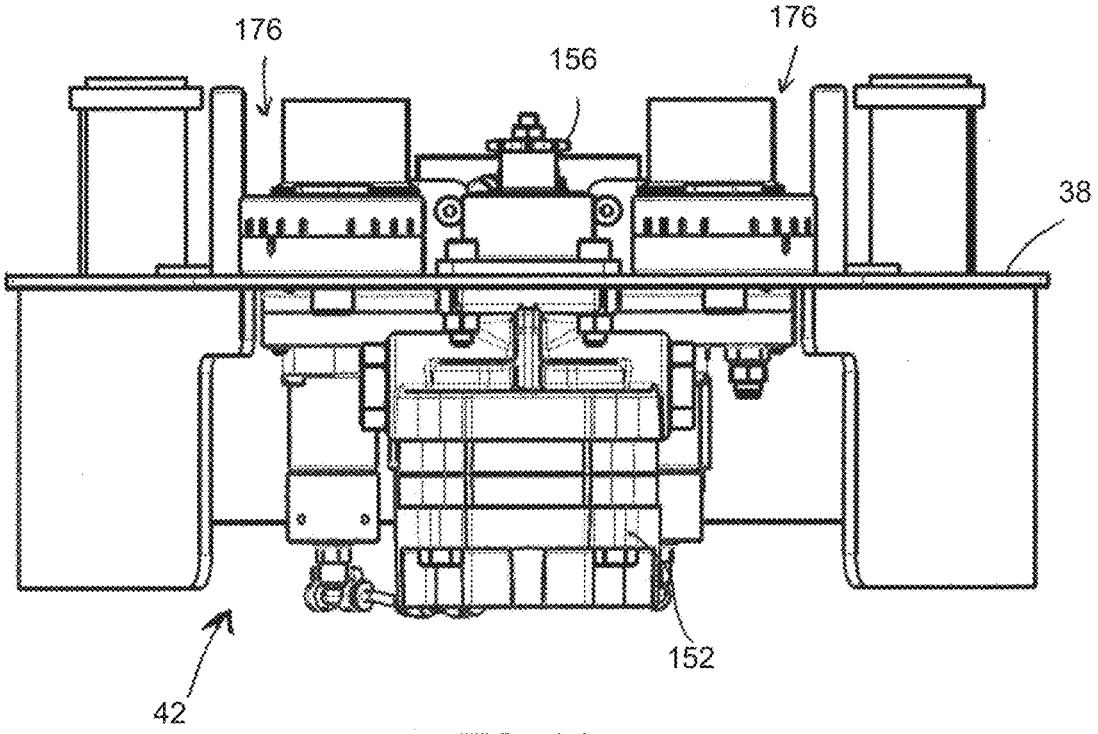
FIG. 14 is an end view of the structure shown in FIG. 12.

The drive assembly 42 includes a motor 152 (FIG. 12), a drive sprocket 156 (FIG. 11) driven by the motor 152 and a flexible member (e.g., a chain 160) driven by the drive sprocket 156. The chain 160 drivingly engages the lock nut 50 (e.g., a second sprocket 164 coupled to the lock nut 50). In other constructions (not shown), the sprocket 164 may be formed with the lock nut 50. As best shown in FIG. 11, the motor 152 rotates the chain 160 via the drive sprocket 156. The chain 160 in turn drives the second sprocket 164, rotating the lock nut 50 relative to the ram 76. As the ram 76 extends or retracts, the lock nut 50 is rotated relative to the threads 108, moving the lock nut 50 linearly along the longitudinal axis 84 of the actuator assembly 30.

During extension and retraction, the ram 76 may be subjected to side or transverse load conditions. Such loads may cause the ram 76 to tilt away from the axis 84 of the cylinder 58. In these conditions, the lock nut 50 tilts with the ram 76 away from the drive sprocket 156, adjusting the distance between the respective axes of the lock nut 50 and the drive sprocket 156, and the flexible chain 160 accommodates this movement.

In the illustrated construction, the drive assembly 42 includes a tension mechanism operable to maintain the tension of the chain 160 and driving engagement between the chain 160 and sprockets 156, 164. The illustrated tension mechanism includes a pair of tensioners 176 on either side of the chain 160 (e.g., on opposite sides of a line extending between the axis of the drive sprocket 156 and the driven sprocket 164).

Each tensioner 176 includes a roller 177 engageable with the surface of the chain 160. A pivotable arm 178 supports each roller 177. Each arm 178 is pivotable about an axis 179 to adjust the spacing between the rollers 177 to take up or allow slack in the chain 160. A biasing member (e.g., a spring (not shown)) biases each arm 178 in a direction of engagement of the roller 177 with the chain 160.

Tilting or pivoting of the ram 76 away from the axis 84 due to side or transverse load conditions may cause the clearance between the lock nut 50 and the support surface to change and/or be non-uniform (increase or decrease depending on the direction of the tilt and the location the clearance is measured). The tilting can result in a gain or loss in the timing between the drive sprocket 156 and the driven sprocket 164 of the lock nut 50. Timing gain causes more spin up but is generally less detrimental to the lift system 10 than timing loss, which reduces lift before lower and spin up. Although too much spin up can contribute to misalignment of the chain, a reduced lift and spin up could result in the lock nut 50 failing to release when the actuator assembly 30 is under load and the operator needs to retract the ram 76.

Figure 15:
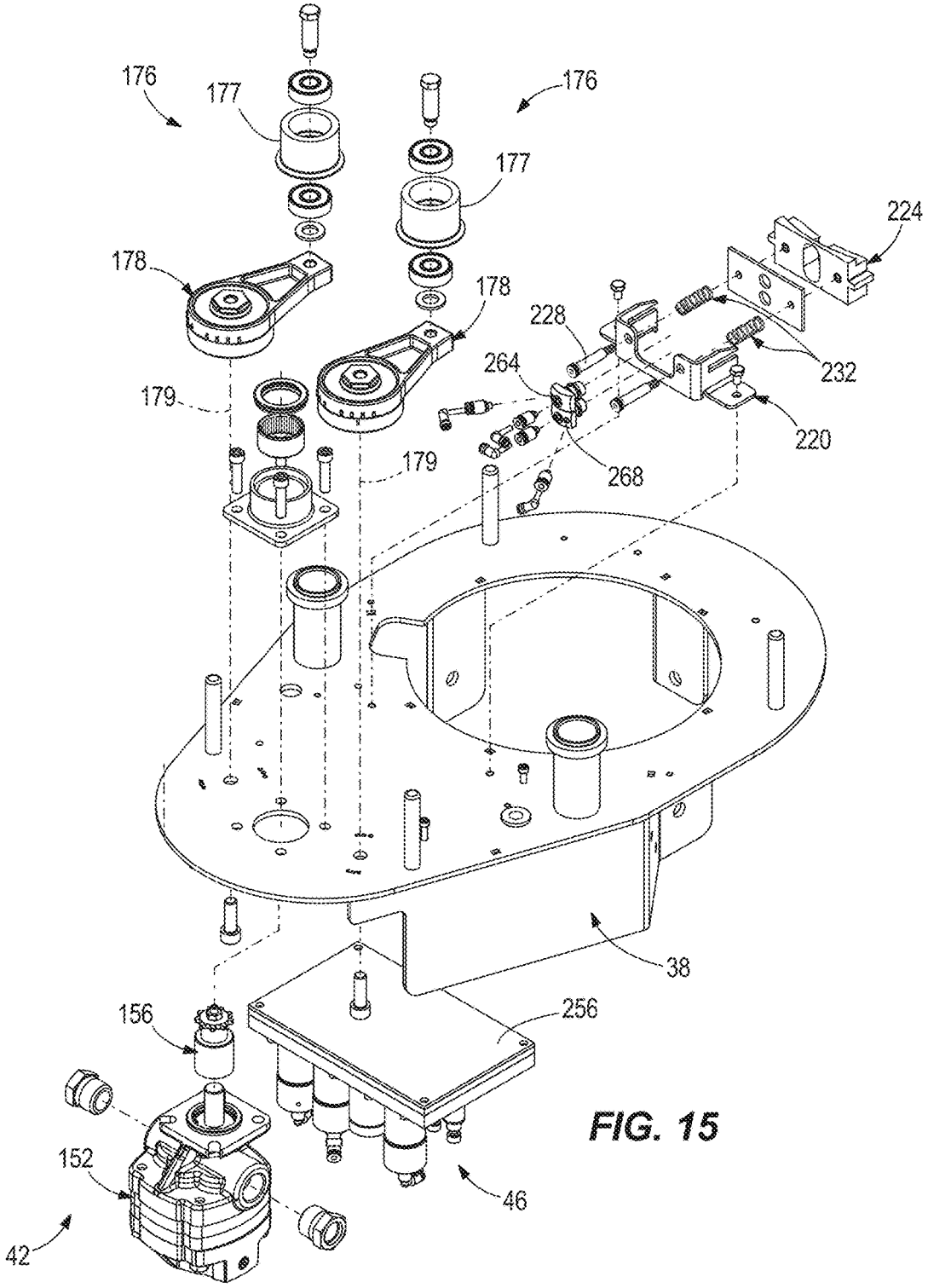
FIG. 15 is an exploded view of the structure shown in FIG. 12.
Figure 16:
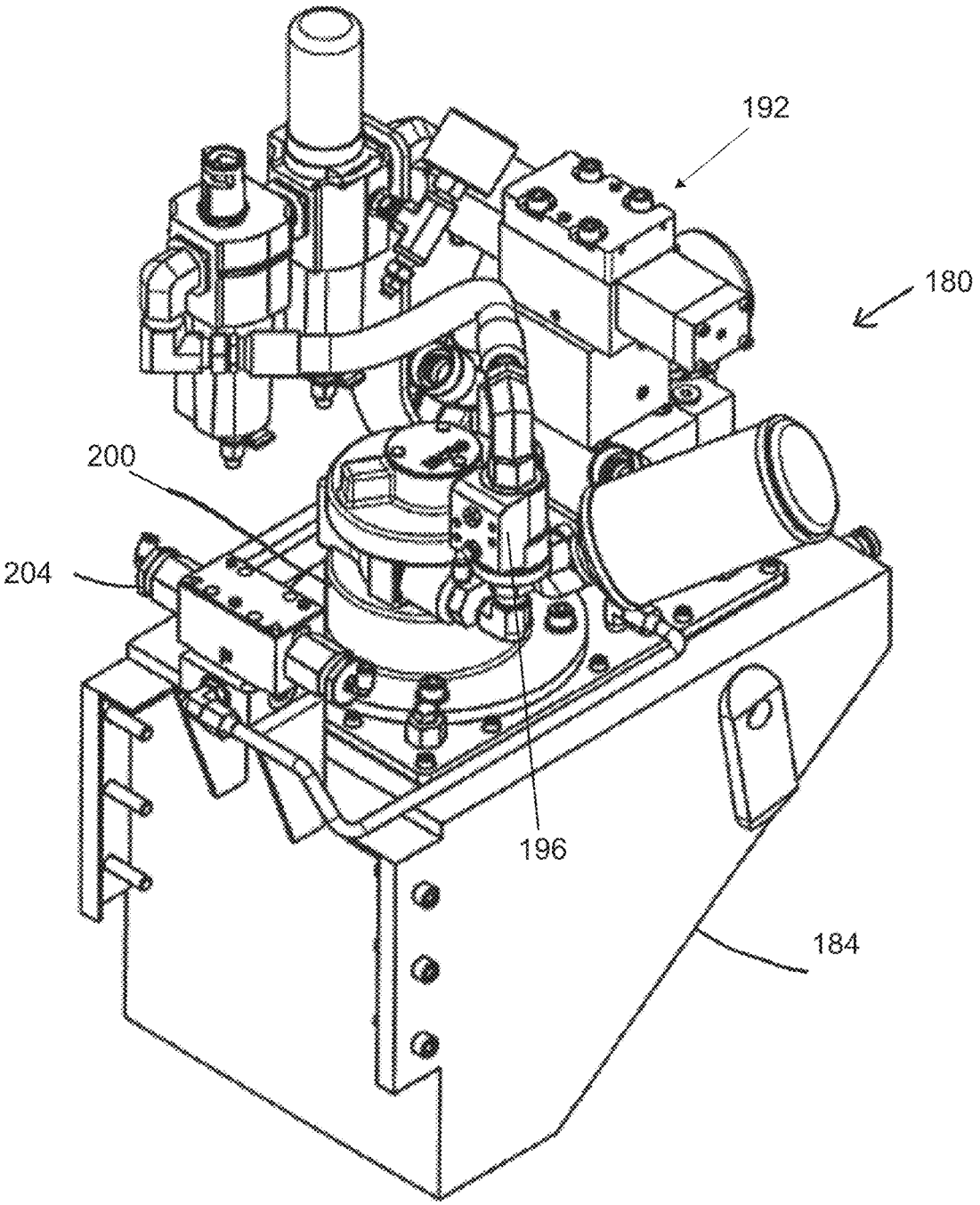
FIG. 16 is a perspective view of a hydraulic circuit structure.
Figure 17:
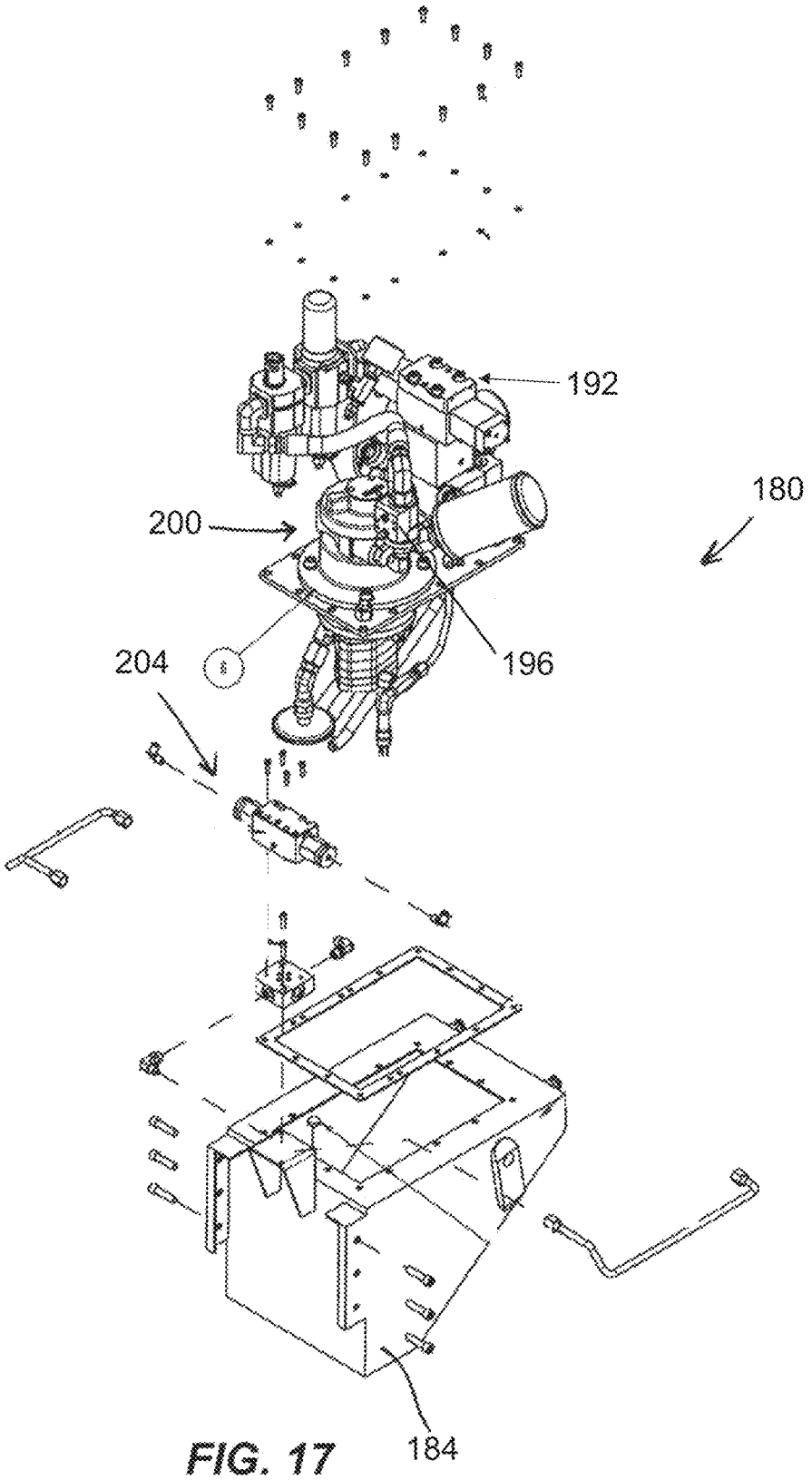
FIG. 17 is an exploded view of the hydraulic circuit structure shown in FIG. 16.
Figure 18:
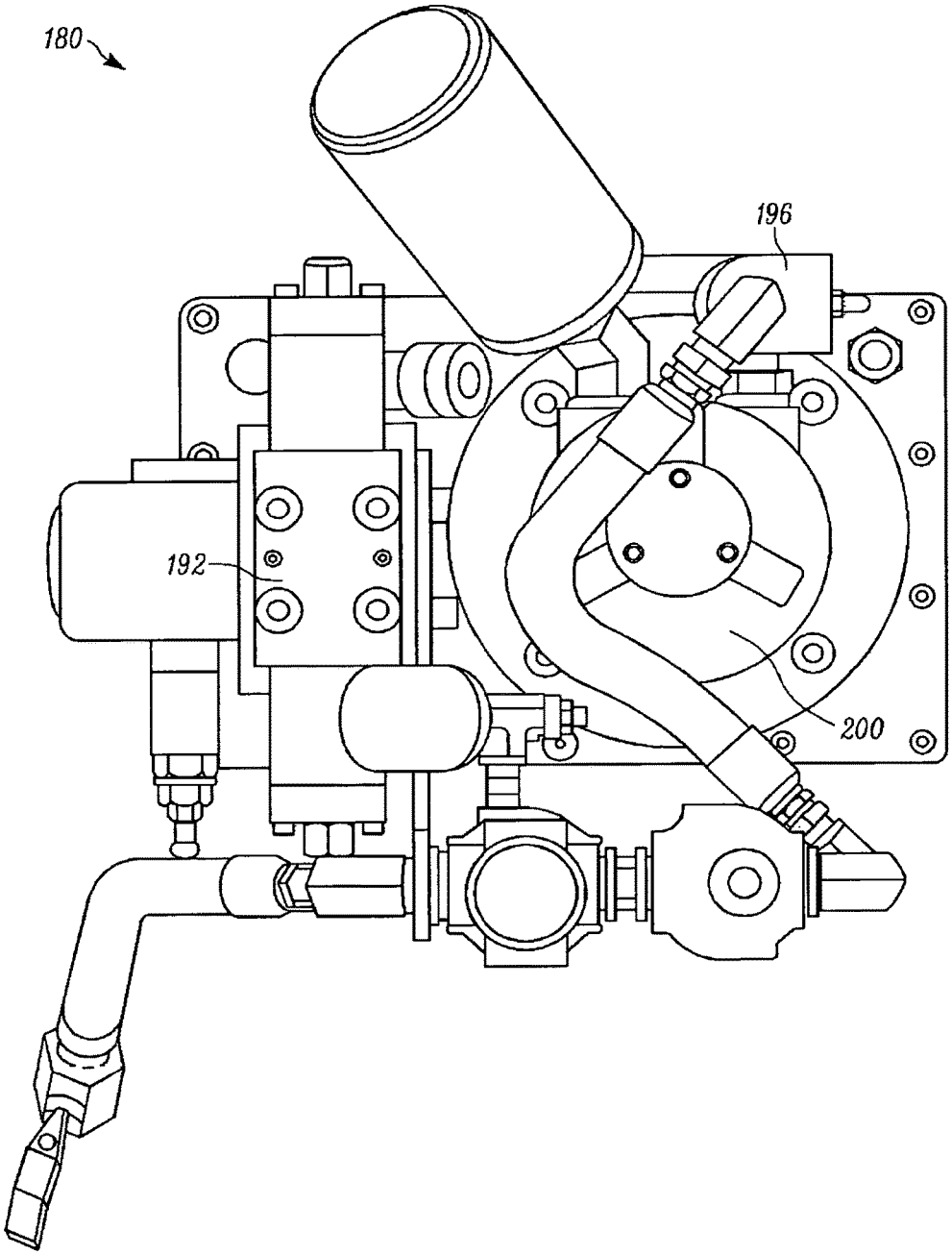
FIG. 18 is a top view of the hydraulic circuit structure shown in FIG. 16.
Figure 19:
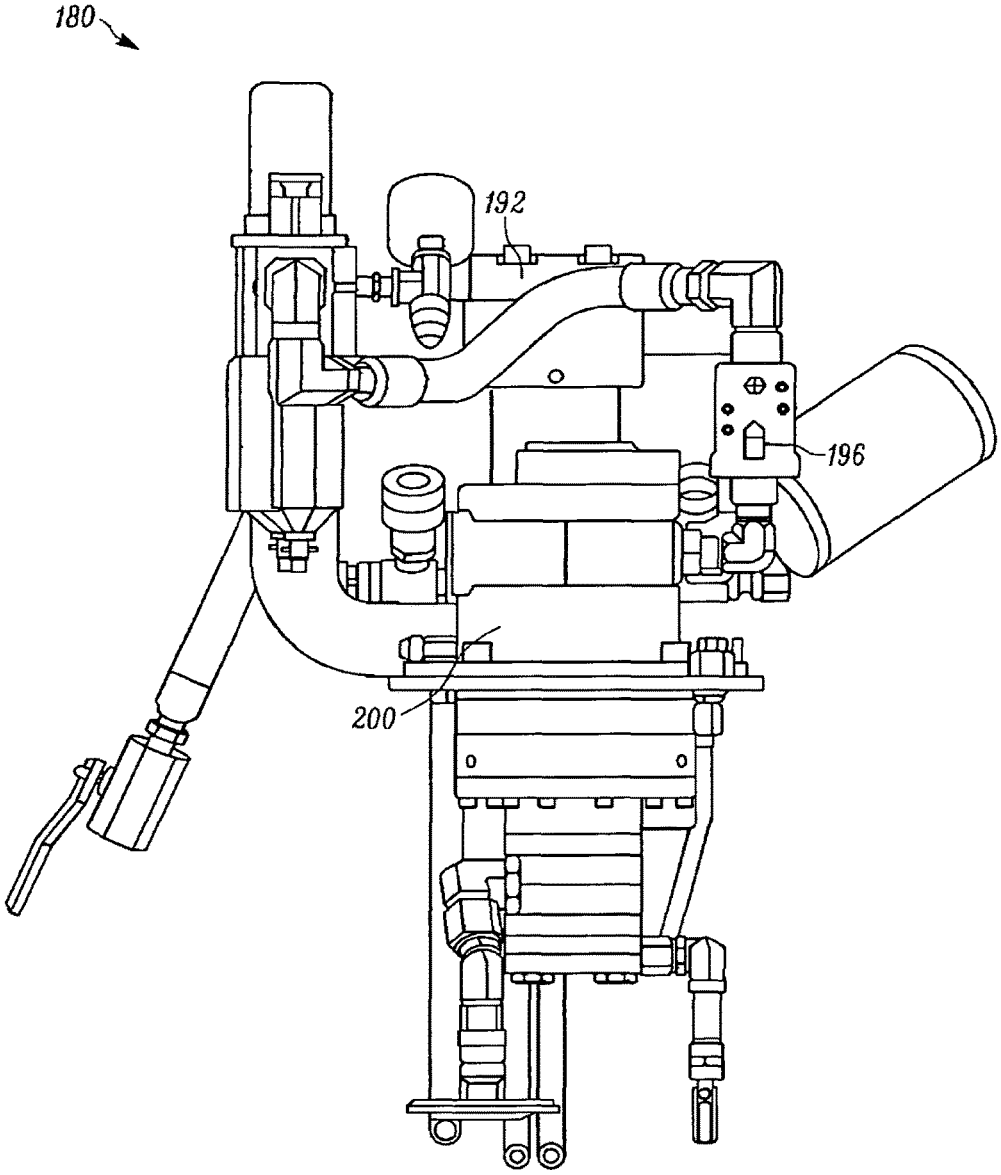
FIG. 19 is a side view of the hydraulic circuit structure shown in FIG. 16.
Figure 20:
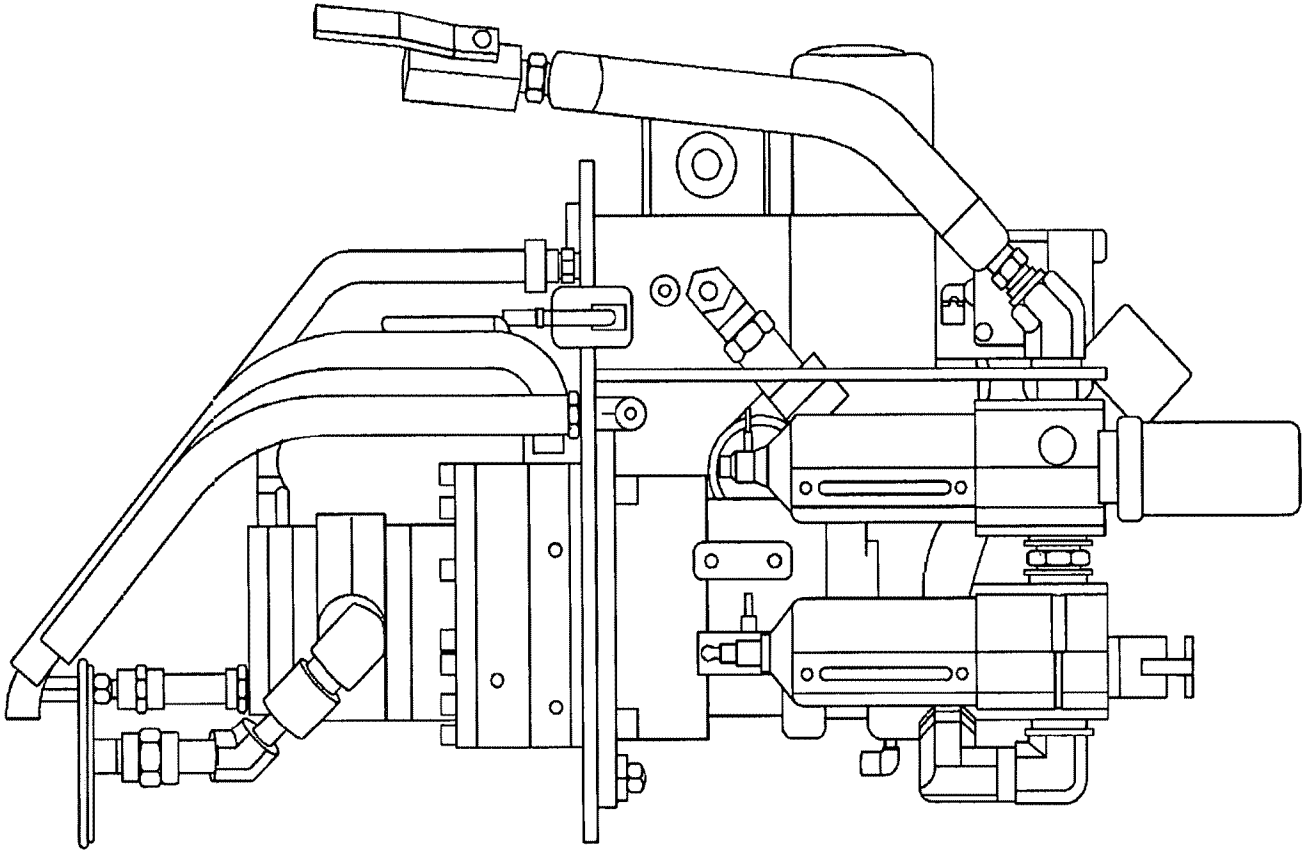
FIG. 20 is a side view of the hydraulic circuit structure shown in FIG. 16.
Figure 21:
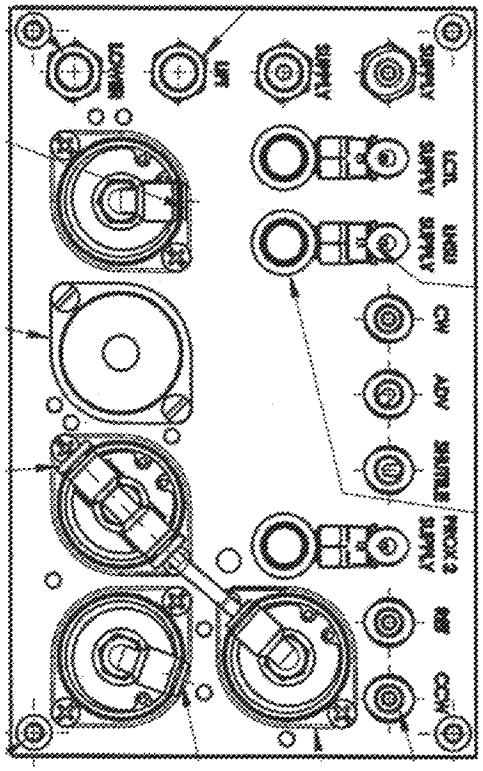
FIG. 21 is a top view of a valve manifold assembly for the air control circuit and an air system.

As best shown in FIG. 15, the logic control system 46 includes a sensor assembly 260 movably coupled to the cover plate 38. The sensor assembly 260 includes a shoe bracket 220 secured to the cover plate 38 and a shoe 224 movably coupled to the shoe bracket 220 (e.g., by a guide track). In the illustrated construction, the shoe 224 is coupled to the shoe bracket 220 by a pair of pins 228 and is biased away from the bracket 220 and toward the actuator assembly 30 by a biasing member (e.g., springs 232).

The shoe 224 engages the lock nut 50. If the ram 76, with the lock nut 50, tilts from the axis 84 of the cylinder 58, the shoe 224 moves to maintain its position relative to the lock nut 50. When the ram 76 tilts away from the drive sprocket 156, the springs 232 force the shoe 224 away from the shoe bracket 220. When the ram 76 tilts toward the drive sprocket 156 and when a force sufficient to overcome the biasing force of the springs 232 is applied to the shoe 224 by the lock nut 50, the shoe 224 slides toward the shoe bracket 220. In other constructions (not shown), the shoe 224 may be movable along a different axis (e.g., an axis parallel to the axis 84) and/or in a different manner (e.g., tilt) to accommodate movement of the lock nut 50.

The sensor assembly 260 further includes a plurality of sensors 264, 268, 272 (FIG. 7). In the illustrated construction, a second or upper or top sensor 264 and a second or lower or bottom sensor 268 are supported in and for movement with the shoe 224 and are positioned adjacent the actuator assembly 30, and the ram sensor 272 is supported on the cylinder 58. The operation of the sensors 264, 268, 272 is described in further detail below.

Referring to FIGS. 16-21, the pressurized fluid (e.g., hydraulic oil) is supplied via a hydraulic circuit 180 including a reservoir 184, a pump 188, and conduits, tubes and pipes connecting the components. The hydraulic circuit 180 provides fluid to power the actuator assembly 30 and turn the lock nut 50 via the chain 160. The hydraulic circuit 180 is arranged to synchronize movement of the ram 76 and the lock nut 50.

The pump 188 is controlled via the logic control system 46 and is configured to provide fluid under pressure to the actuator assembly 30. In the illustrated construction, the motor 152 is hydraulically-driven, and the pump 188 also provides fluid to drive the motor 152 (FIG. 15). In other constructions (not shown), the pump 188 may drive one of the actuator assembly 30 and the motor 152, and a second pump (not shown) may provide fluid to drive the other of the actuator assembly 30 and the motor 152.

In the hydraulic circuit 180, a first valve 192 controls the flow of hydraulic fluid to the actuator assembly 30, and a second valve 196 controls the supply of air to an air motor 200 of the logic control system 46. A third valve 204 is configured to shift the direction of rotation of the fluid motor 152.

Figure 22:
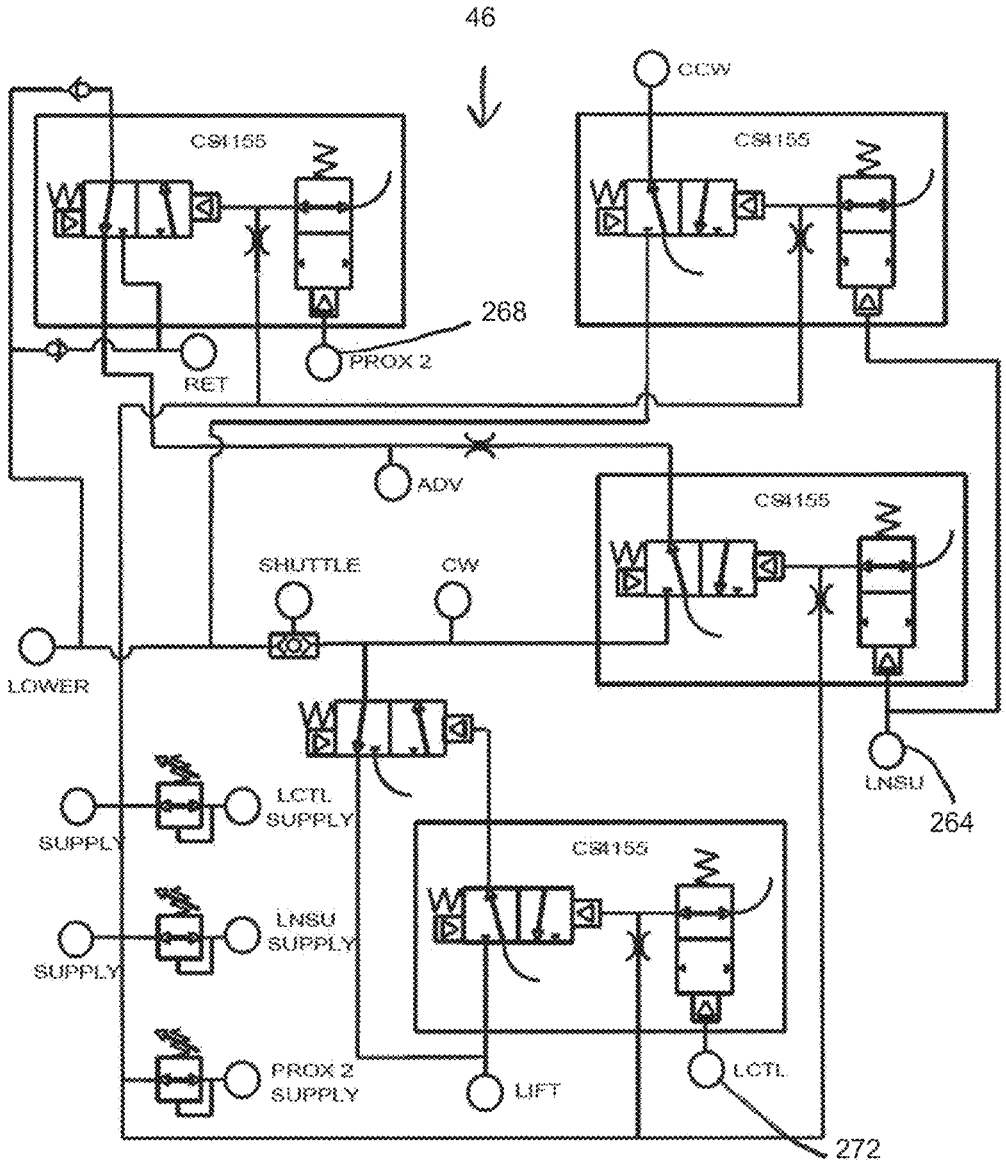
FIG. 22 is a schematic diagram of the air control circuit.
Figure 23:
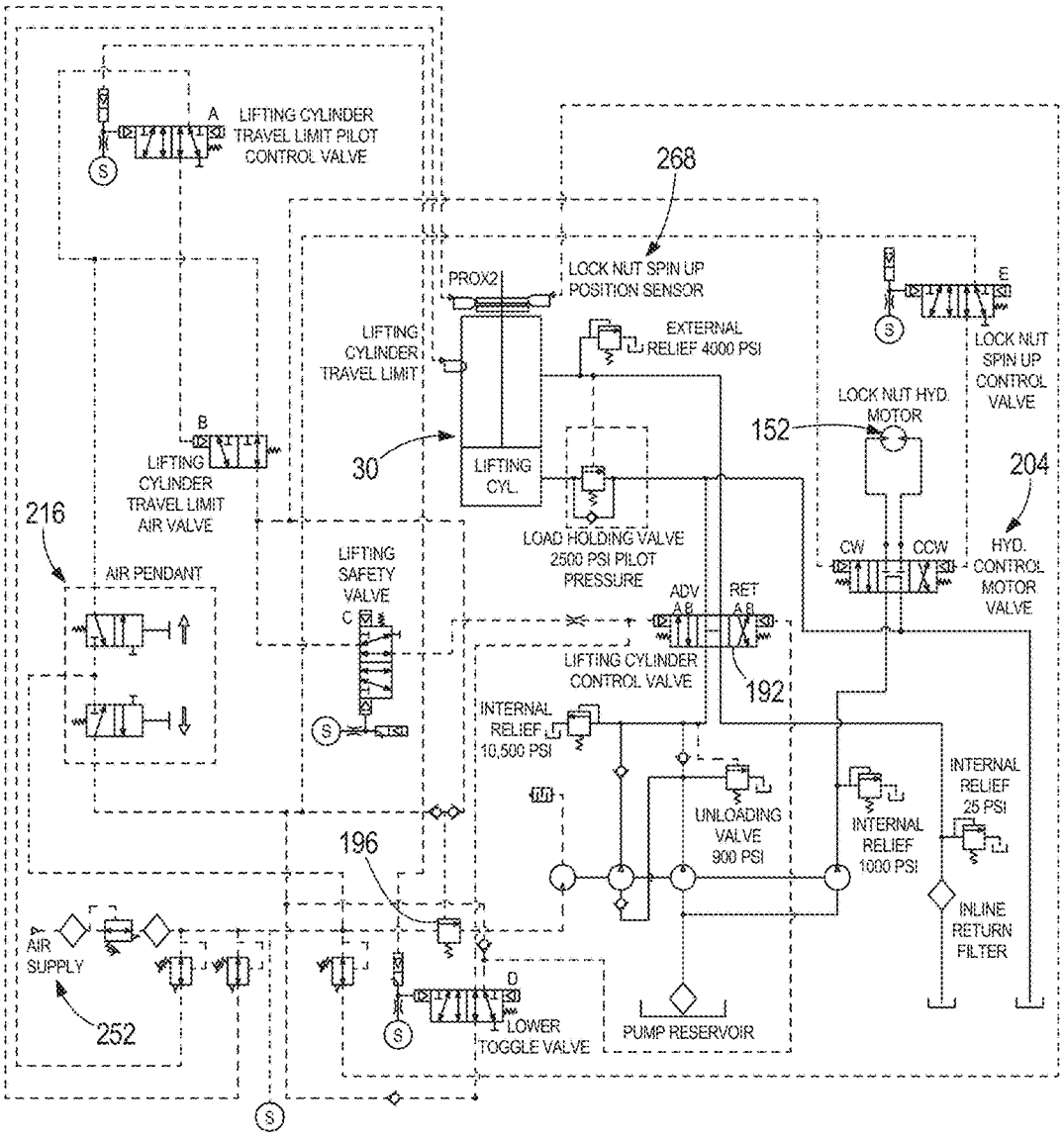
FIG. 23 is a schematic view of a hydraulic and pneumatic system.
Figure 36:
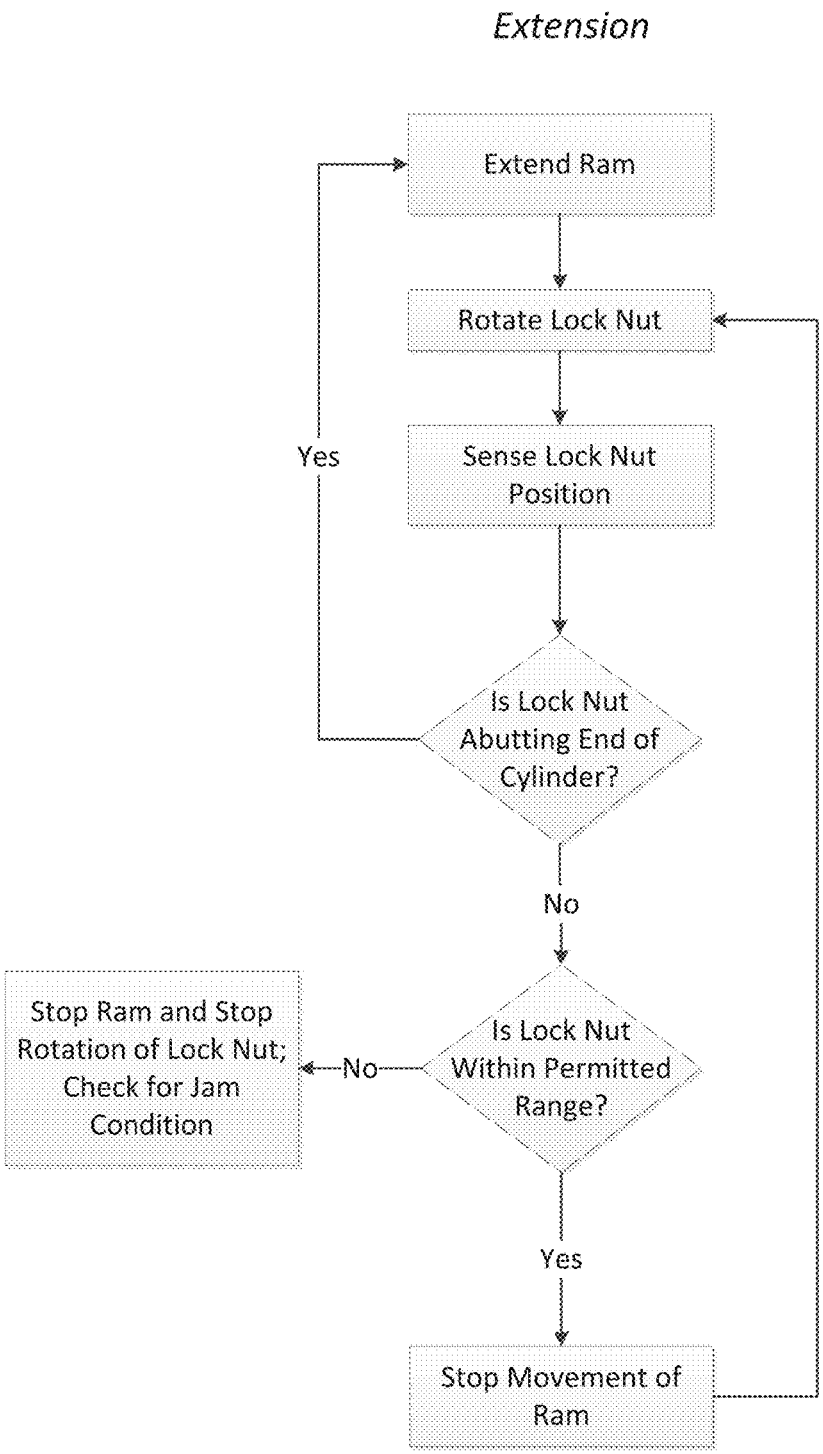
FIG. 36 is a diagram of the extension operation of the lift system.
Figure 37:
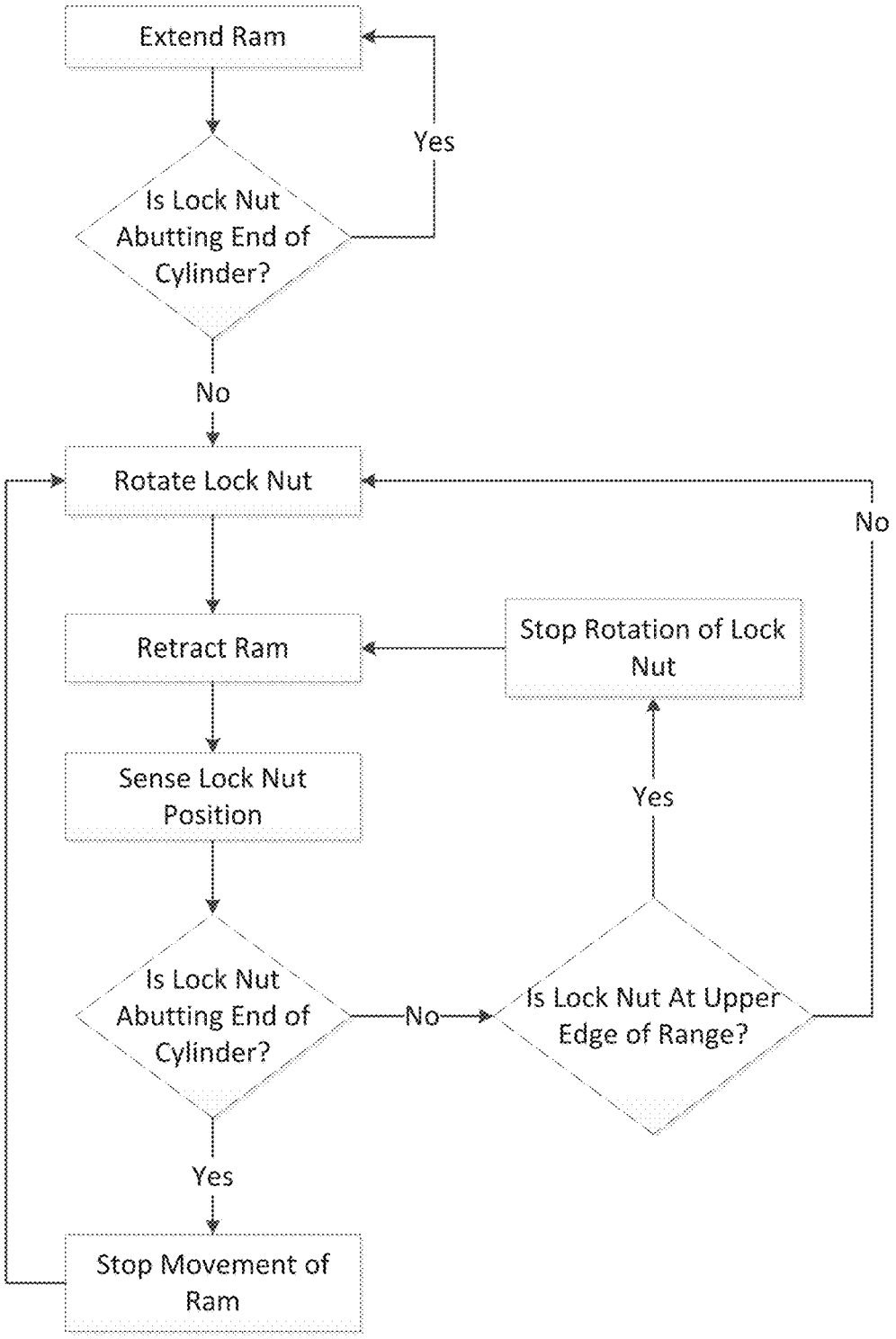
FIG. 37 is a diagram of the retraction operation of the lift system.

FIGS. 22-23 schematically illustrate the logic control system 46, which synchronizes the rotation of the lock nut 50 (and therefore the axial movement of the lock nut 50) and extension and retraction of the ram 76. The logic control system 46 includes an air supply 252, a manifold 256, the air motor 200, the sensors 264, 268, 272, and an air pump. In the illustrated construction, each of the sensors 264, 268, 272 are non-contact proximity air sensors configured to sense a blockage in front of the sensor 264, 268, 272. In response to being blocked, the sensor 264, 268, 272 returns a pressure signal to the logic control system 46. In the illustrated construction, the working medium is air; in other construction, the working medium may be another fluid. Furthermore, in other embodiments, the sensors 264, 268, 272 may be another type of non-contact proximity sensor (e.g., a laser sensor or an infrared sensor). In addition, FIGS. 36 and 37 illustrates the basic operation of the lift system during extension and retraction of the ram 76.

In one construction, the hydraulic circuit 180 includes three hydraulic pumps, each driven by a common power source providing compressed air. One hydraulic pump rotates the lock nut 50, a second pump provides low pressure fluid for a first stage or speed-lifting operation of the actuator assembly 30, and the third pump provides higher pressure fluid for higher load-lifting operation of the actuator assembly 30. The power source also provides motive force to operate the pneumatically-driven pumps and to actuate the valves in the logic control circuit.

A user-controlled pendant 216 (shown schematically in FIG. 23 and physically in FIG. 3) is coupled to the lift system 10 and controls the lift system 10 from a distance away (e.g., 20 feet). The pendant 216 includes an extend switch and a retract switch, and controls operation of the logic control system 46 and the hydraulic circuit 180. When a user actuates the extend switch, the logic control system 46 sends pilot pressure to the advance pilot of the first valve 192 that controls the actuator 30, and to the pilot of the second valve 196 to supply air to the air motor 200. Simultaneously, the logic control system 46 sends pilot pressure to the third valve 204 to control the direction of the fluid motor 152 and cause it to rotate in a first direction (e.g., clockwise when viewed from above). As a result, the lock nut 50 rotates down the external threads 108 of the ram 76 as the ram 76 extends relative to the cylinder 58.

The lock nut 50 defines (see FIGS. 24, 24A, 25, 25A) an external annular groove 172 proximate the ram 76. The top sensor 264 is positioned vertically above (i.e., in the extension direction 116) the top edge of the annular groove 172 when the lock nut 50 is in contact with the support surface (e.g., the top of the cylinder 58). The bottom sensor 268 is positioned vertically above the lower edge of the annular groove 172 and is configured to be uncovered (i.e., aligned with the groove 172) when the lock nut 50 is in contact against the support surface.

The ram sensor 272 is mounted in a side of the actuator assembly 30 and is positioned parallel to the actuator assembly 30. The ram sensor 272 is positioned near the top of the cylinder 58 and is configured such that, when the ram 76 reaches the end of its operating stroke, an edge of the lower portion 92 of the ram 76 covers the ram sensor 272.

Pressurized fluid in the hydraulic circuit 180 synchronously moves the ram 76 in the actuator assembly 30 and rotates the lock nut 50 via the fluid motor 152 so that the lock nut 50 and ram 76 move in concert. That is, when the ram 76 is extended, the lock nut 50 is rotated so that the lock nut 50 moves axially in the opposite direction to engage the support surface 68, the top of the cylinder 58 in the illustrated construction. When the ram 76 is retracted, the lock nut 50 is rotated to move axially in the opposite direction to allow for retraction of the ram 76 and to maintain relative proximity for engagement with the support surface 68.

In some constructions, the lock nut 50 rotates quickly (e.g., 70 rpm), thereby causing the lock nut 50 to move along the longitudinal axis 84 of the cylinder and along the external threads 108 at a high linear velocity (e.g., 32.5 inches per minute). In some constructions, the ram 76 extends and retracts at a maximum rate of approximately half the linear velocity of the lock nut 50.

Movement of the lock nut 50 during extension of the ram 76 is limited by the relatively slow lifting rate of the ram 76 because the lock nut 50 does not receive enough torque from the fluid motor 152 to increase the extension speed of the ram 76. For example, the maximum force on the lock nut 50 from the fluid motor 152 via the chain 160 may be only 200 pounds.

As a result of the difference between the linear speed of the lock nut 50 and the linear speed of the ram 76, more torque than is required to keep the lock nut 50 in contact with the support surface is transmitted to the lock nut 50. In other words, an excess amount of torque is continuously provided to the lock nut 50, causing the lock nut 50 to jam or overtighten on the external threads 108 and against the support surface (the top of the cylinder 58). When the lock nut 50 jams, any excess oil delivered to the hydraulic motor 152 by the pump is exhausted to the reservoir 184.

This overtightening of the lock nut 50 continuously occurs as the ram 76 extends because the lock nut 50 is continually being forced to move downwardly into engagement with the top of the cylinder 58. The overtightening limits or prevents formation of a significant gap between the lock nut 50 between the support surface 68 during extension of the ram 76.

Overtightening the lock nut 50 allows for the position of the ram 76 to be maintained, for example, in case of a rapid loss of hydraulic pressure during the lifting or lowering of a load. The ram 76 is held in place by engagement of the interior threads of the lock nut 50 and the external threads 108 of the upper portion 96 of the ram 76. Unwanted movement of the load is thus prevented throughout the extension and retraction of the ram 76, thereby preventing damage of the load and other objects in the lifting area. In one construction, the lift system 10 may conform to national standard ANSI-ASME B30.1:2009 for jacks, and international standards AS/NZS 2538:2004 Vehicle for support stands, and AS/NCZ 2693:2007 for vehicle jacks.

If for any reason the lock nut 50 does not spin during extension of the ram 76 (i.e., due to the chain 160 stopping, debris jamming the threads on the lock nut 50, etc.), the annular groove 172 on the lock nut 50 will be positioned vertically above the bottom sensor 268, and the bottom of the lock nut 50 will uncover the top sensor 264 and cover the bottom sensor 268. In this case, if the extend button is pressed, the logic control system 46 releases the pilot signal to the first valve 192 and stops the ram 76 from extending.

As the ram 76 reaches the top of its operating stroke, the ram sensor 272 becomes blocked or covered by the top edge of the lower portion 92 of the ram 76. This results in a signal from the ram sensor 272 to release the pilot signals on each of the valves 192, 196, and 204, preventing further extension of the ram 76.

In some cases, the downward axial load on the lock nut 50 may be larger than the axial load applied to the lock nut 50 during extension, and the lock nut 50 may be prevented from moving upwardly with the given torque provided by the motor 152 via the chain 160. Therefore, the lock nut 50 must be lifted off of the top of the cylinder 58 so the lock nut 50 is able to spin from the torque delivered by the chain 160.

At the top of the operating stroke, a distance remains for the ram 76 to be lifted before it reaches its maximum stroke. Extension of the remaining distance un-jams and disengages the lock nut 50 from the support surface 68 (the top of the cylinder 58). This disengagement allows for subsequent refraction of the ram 76 when the user has pressed the retract button of the pendant 216. When a user presses the retract button of the pendant 216, the ram 76 is first extended the remaining distance such that the lock nut 50 no longer engages the support surface, and the lock nut 50 is able to spin under the torque delivered by the chain 160.

Similar to the extension process, when retracting the ram 76, the lock nut 50 has a linear velocity in the extension direction 116 exceeding the retraction velocity of the ram 76. When the retract button on the pendant 216 is pressed, the air logic system 46 supplies pilot pressure to actuate the third valve 204 so the hydraulic motor 152 spins the lock nut 50 in an opposite, second direction (e.g., counter clockwise when viewed from above). When the retract button on the pendant 216 is pressed, the air logic system 46 also provides pilot pressure to actuate the first valve 192 to provide hydraulic pressure to extend the actuator 30. The ram 76 extends until the lower edge for groove 172 in lock nut 50 covers the bottom sensor 268 (i.e., high). The elevation of the lock nut can occur from either the advance of the ram 76 or by rotation from the hydraulic motor once the load on the lock nut is low enough to be overcome by the torque of the hydraulic motor circuit, or a combination of the two. When the bottom sensor 268 is covered (i.e., high) the air logic system 46 changes the pilot signal to the first valve 192 controlling the direction of the actuator 30 causing ram 76 to reverse direction from advance to retract.

In this direction, the lock nut 50 spins up the external threads 108, causing the top edge of annular groove 172 on the lock nut 50 to vertically align with the top sensor 264. The sensor 264 is now uncovered (i.e., low), and the change in signal condition from covered to uncovered directs the air logic to turn off the flow of hydraulic fluid to the hydraulic motor 152 via the third valve 204. The ram 76 continues to move in the retraction direction 120, and the lock nut 50 moves in the same direction with the ram 76, causing the top sensor 264 to again be misaligned with the groove 172 and covered by the lock nut 50. The top sensor 264 changes state to high. When this occurs, the air logic directs the third valve 204 to again cause the hydraulic motor 152 to spin the lock nut 50 in the second direction and up the external threads 108.

Because the linear velocity of the lock nut 50 exceeds that of the ram 76, the top sensor 264 is alternatively covered and uncovered (i.e., covered by the lock nut 50 and uncovered by or aligned with the annular groove 172 in the lock nut 50). The top sensor 264 thus toggles between high and low states as the ram 76 lowers, resulting in a start-and-stop movement as the ram 76 is refracted.

Referring again to FIGS. 5-6, the base 34 balances the actuator assembly 30 and disperses compressive forces from loads that may be lifted, supported, or lowered by the lift system 10. In one construction, the base 34 may provide a ratio of support distance relative to the axis 84 to the maximum height of the lifting system 10 to have a stability factor allowing the lift system 10 to be classified as a vehicle support stand under Australia New Zealand Vehicle Support Standard AS/NCZ 2538:2004.

The illustrated foot member 136 provides some resiliency or spring action against the ground. The foot member 136 has a curved peripheral edge 280 and an upper surface 284 with a flat interior portion supporting the actuator assembly 30 and a portion that tapers downwardly toward the peripheral edge 280. That is, the foot member 136 is thicker near the axis 84 and thinner at the peripheral edge 280. The relatively thinner peripheral portion is more flexible than the center portion to provide resiliency or spring action against the ground. The foot member 136 is generally mushroom-shaped and also includes cutouts 288 (FIG. 6) defining multiple flanges. Among other things, the cutouts 288 facilitate ground clearance and provide clearance for the wheels 26. In other embodiments, the foot member 136 may not include any cutouts.

The flat portion of the upper surface 284 is generally perpendicular to the ram 76. The foot member 136 defines a central blind bore 296 receiving the bottom end 64 of the actuator assembly 30. Fasteners and a gasket 302 secure and seal the foot member 136 and the bottom end 64 and to the sleeve 132. The gasket 302 resiliently biases the sleeve 132 away from foot member 136 on the cylinder 58. The flexible spacing of the sleeve 132 from the foot member 136 prevents contact between the sleeve 132 and the foot member 136 when the foot member 136 deflects like a spring.

FIGS. 26-30 illustrate an extension assembly for the lift system 10. The extension system includes several types of connectors configured to be coupled to the top of the actuator assembly 30 (i.e., in the extension direction 116), thereby increasing the reach and/or lifting height of the ram 76. The extension system prevents improper stacking when using more than one extension component on the ram 76 (e.g., by not permitting a user to stack incompatible components).

Figure 26:
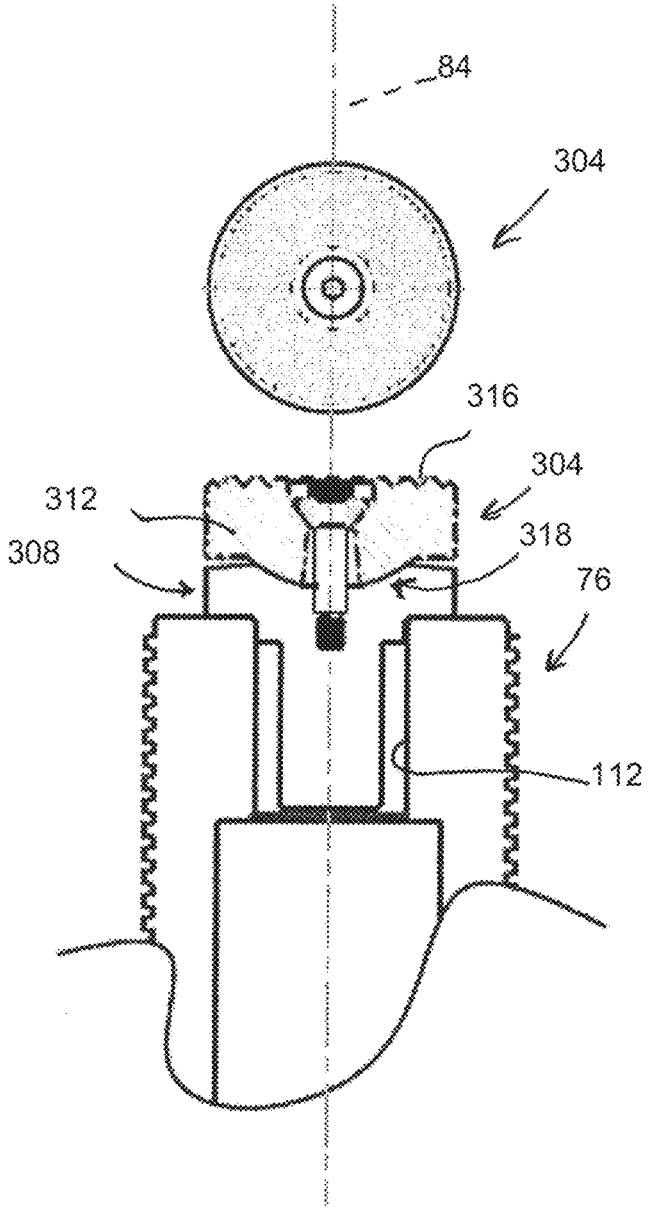
FIG. 26 is a side view of an actuator assembly and a first arrangement of an extension assembly.

As shown in FIG. 26, in one configuration, a load cap or swivel cap 304 includes a grip member 312 and a stem 308 received in the bore 112 on the end of the ram 76. In the illustrated construction, the grip member 312 has a serrated top surface 316 for enhancing the grip or frictional force between the swivel cap 304 and the load. The serrated surface 316 also reduces side-loading on the actuator assembly 30. The stem 308 has a stepped shape in order to engage holes of various diameters (e.g., in the ram 76 or in other components of the extension system described below).

The grip member 312 is coupled to the swivel cap stem 308 by a ball-and-socket joint 318, allowing the grip member 312 to pivot transverse to the axis 84 along which the ram 76 moves. The pivoting movement permits the swivel cap stem 308 to accommodate initial misalignment and some tilting of an object being lifted by the lift system 10. In one construction, the grip member 312 can pivot up to six degrees relative to the longitudinal axis 84. In other embodiments (not shown), the load cap 304 may include a grip member 312 that is fixed to the stem 308 without swiveling. This alternative construction may provide a lower overall height.

Figure 27:
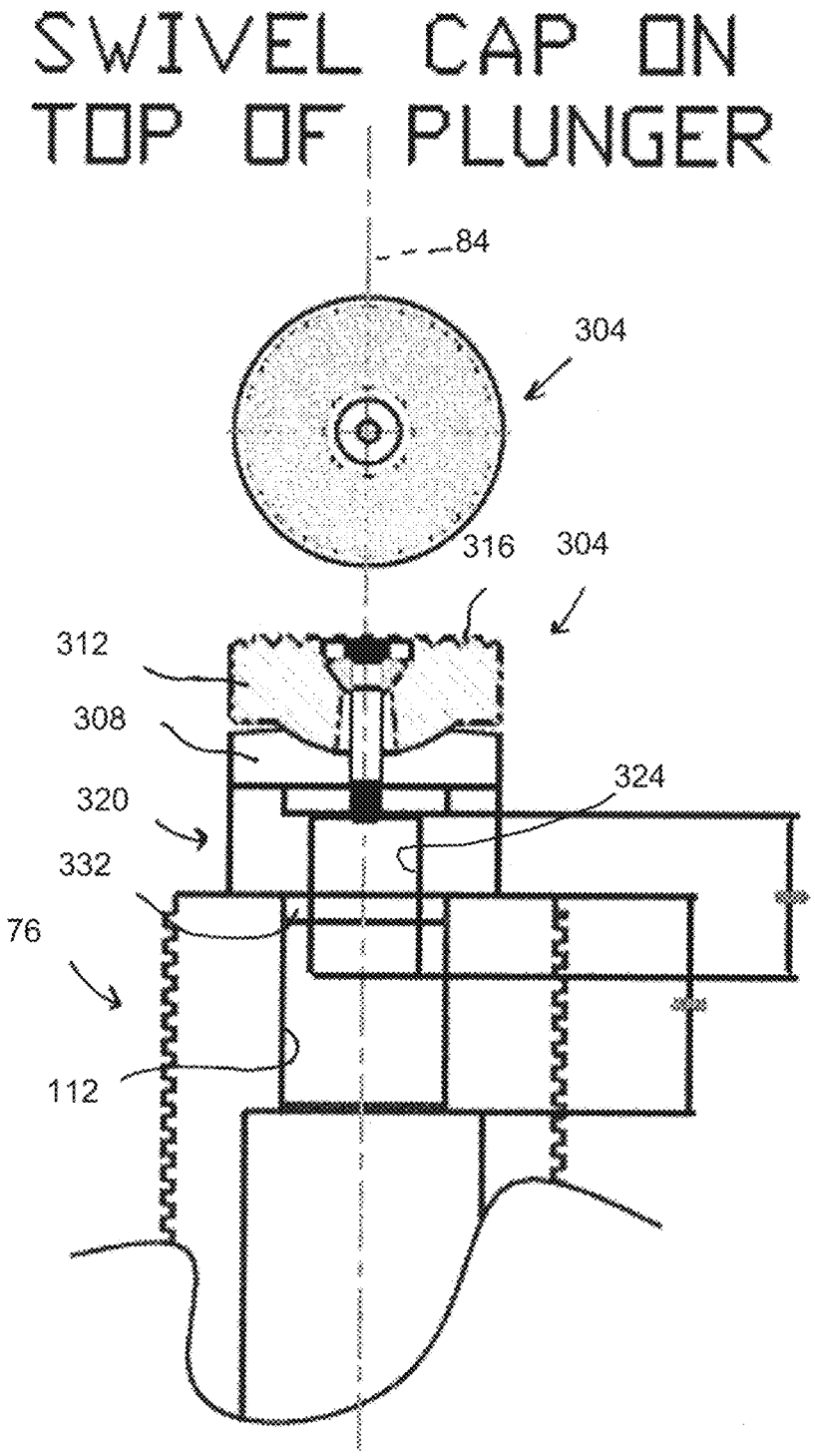
FIG. 27 is a side view of the actuator assembly and a second arrangement of the extension assembly.

FIG. 27 shows another configuration in which a spacer 320 is positioned between the swivel cap 304 and the end of the ram 76. The spacer 320 defines a stepped bore 324 configured to receive the stem 308 of the swivel cap 304 and to extend into the bore 112 in the end of the ram 76. In some constructions, the spacer 320 may extend the height of the swivel cap 304 by one inch, two inches, or any other desired length. Multiple spacers 320 may also be stacked on top of one another.

In one construction, each spacer 320 includes one or more stepped protrusions 332 extending in the retraction direction 120 to engage the bore 112 of the ram 76. In the illustrated construction, the protrusion 332 mirrors the stepped shape of the swivel cap stem 308; however, in other constructions, the protrusion 332 may have a different size and shape from the stem 308. In further constructions, the protrusion 332 may extend in the extension direction 116. The swivel cap stem 308 has a step configured to engage a counterbore of the stepped bore 324 in the spacer 320.

Figure 28:
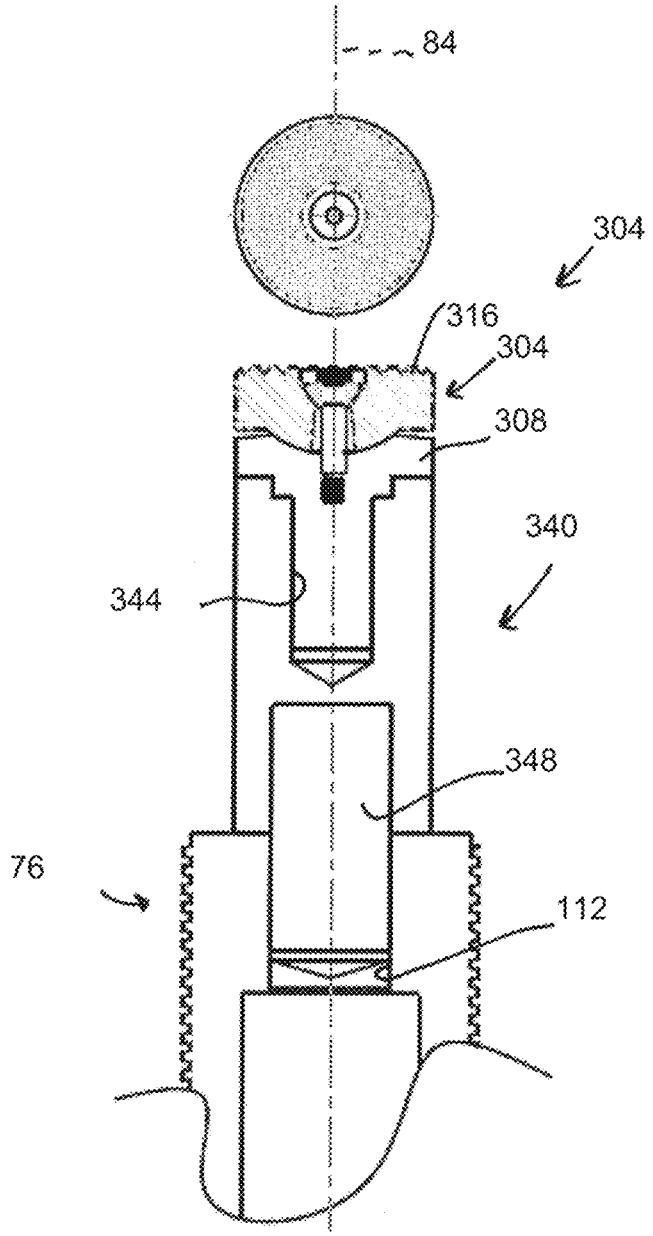
FIG. 28 is a side view of an actuator assembly and a third arrangement of the extension assembly.
Figure 29:
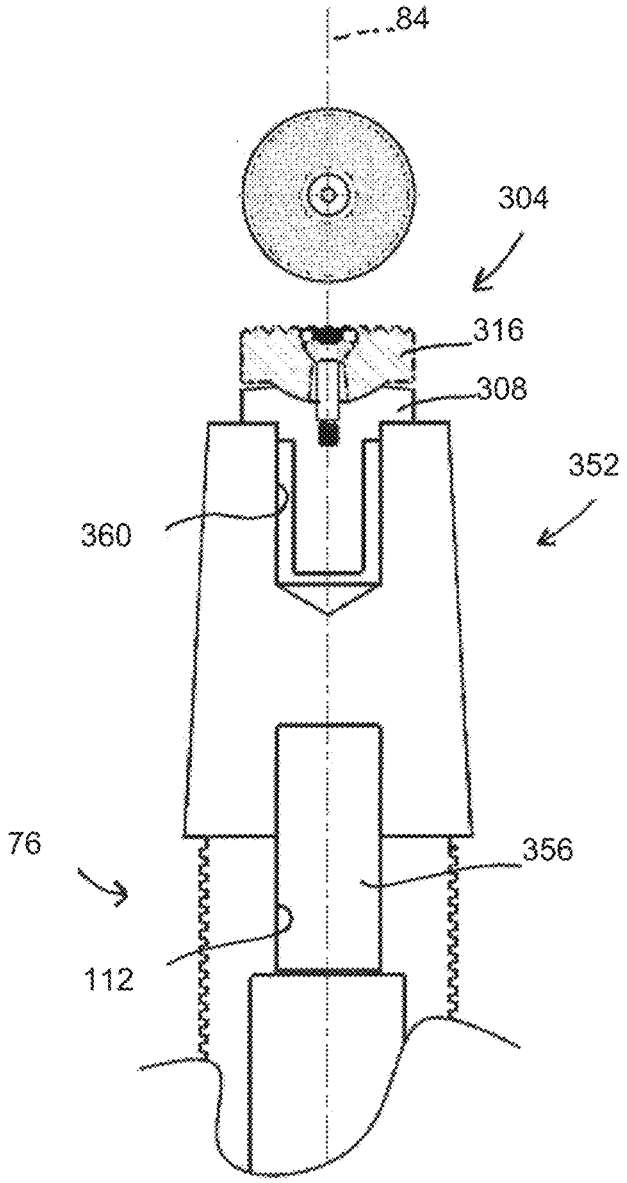
FIG. 29 is a side view of an actuator assembly and a fourth arrangement of the extension assembly.
Figure 30:
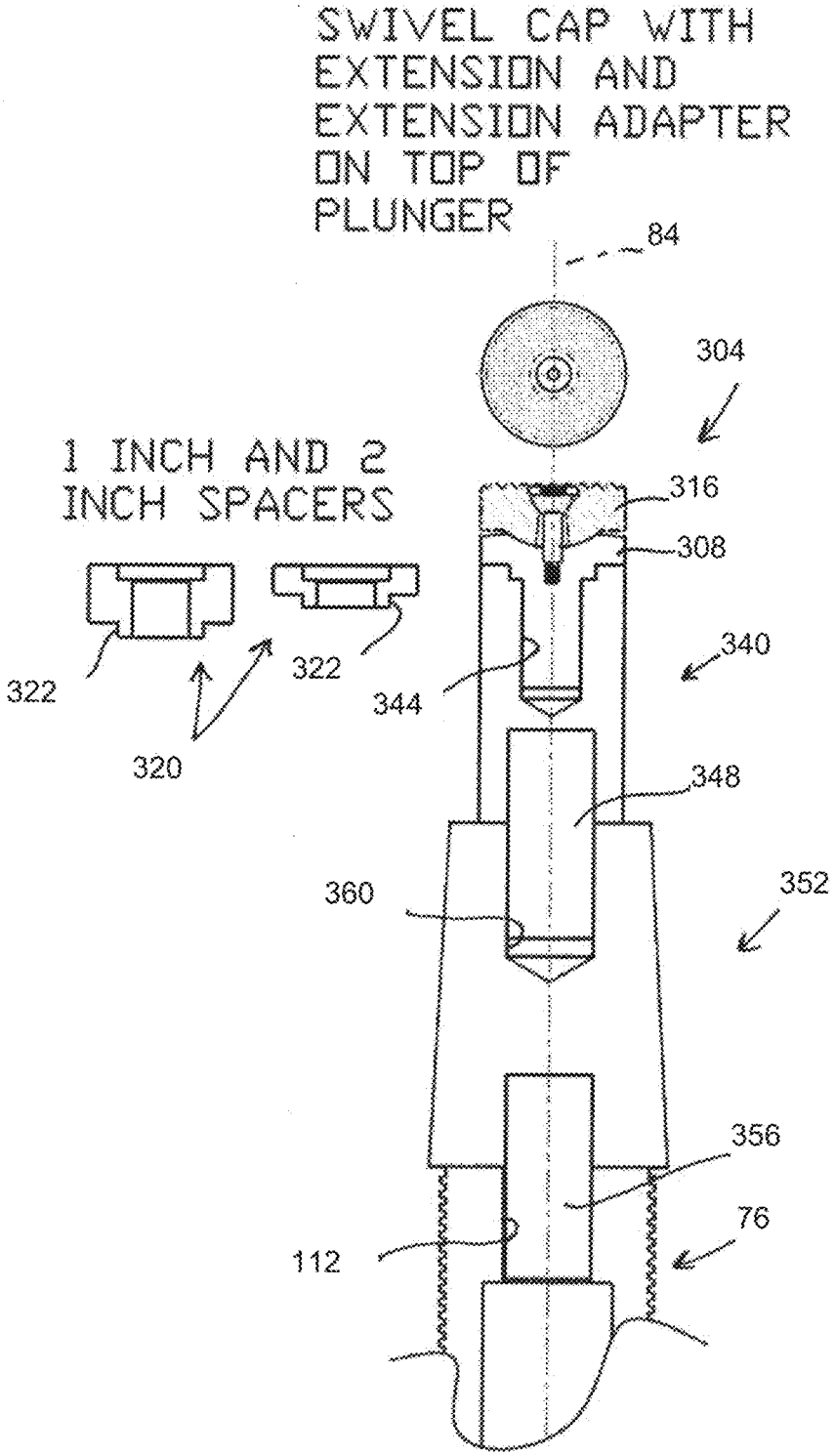
FIG. 30 is a side view of an actuator assembly and a fifth arrangement of the extension assembly.
Figure 31:
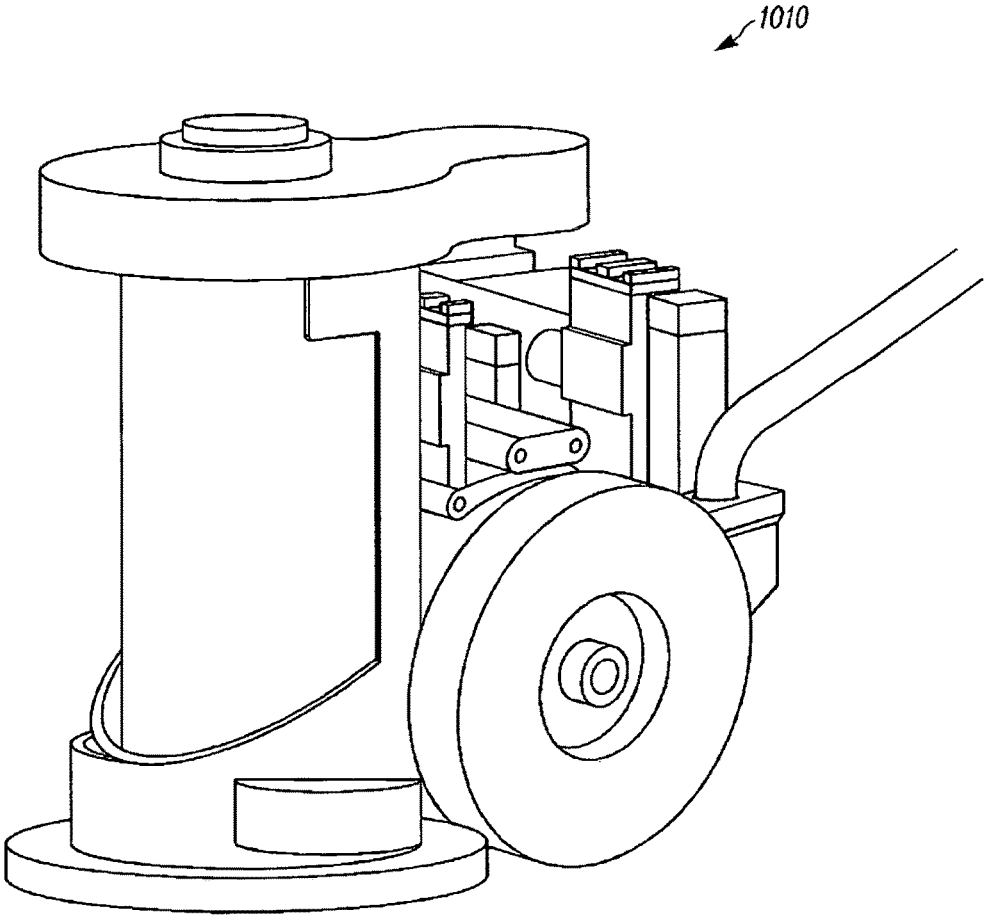
FIG. 31 is a perspective view of an alternative construction of a lift system.

In another configuration, shown in FIG. 28, the swivel cap 304 is coupled to an extension part 340 having a stepped bore 344 receiving the swivel cap stem 308. The extension part 340 includes a pin 348 received in the bore 112 of the end of the ram 76. In FIG. 29, the swivel cap 304 is coupled to an extension adaptor 352 having a slot 360 receiving the swivel cap stem 308. The extension adaptor 352 also includes a locating pin 356 received in the bore 112 of the ram 76 but has a wider base than the extension part 340 to engage a larger portion of the top end of the ram 76.

The components of the extension assembly described above and shown in FIGS. 27-29 can be combined in various ways. The spacer 320, the extension part 340, and the extension adaptor 352 are each configured to be individually coupled to the bore 112 of the ram 76, and the swivel cap 304 may be coupled to any of these components. The swivel cap 304 may be directly coupled to the bore 112 of the ram 76 (FIG. 26), to one or more spacers 320 (FIG. 27), to the extension part 340 (FIG. 28), or to the extension adaptor 352 (FIG. 29) to support a load on the ram 76. In addition, in the illustrated construction, the stepped protrusion 332 on the spacer 320 permits the spacer 320 to be coupled to the bore 112 of the ram 76, to the stepped bore 344 of the extension part 340, or to the stepped bore 360 of the extension adaptor 352.

The various components of the extension assembly may be combined to achieve a desired extension. In the configuration shown in FIG. 30, the swivel cap 304 is coupled to the extension part 340, and the extension part 340 in turn is coupled to the end of the extension adaptor 352. The pin 348 of the extension part 340 is received in the bore 360 of the extension adaptor 352, and the pin 356 of the extension adaptor is in turn received in the bore 112 of the ram 76. To accommodate various extension needs, the extension part 340 can be formed to any desired size (e.g., from 5 to 14 inches in length, or any other desired length). The extension adaptor 352 is configured to engage the top of the ram 76 and, optionally, to allow the extension part 340 to be coupled to the top end of the extension adaptor 352. The illustrated extension system eliminates the risk of improper stacking because the extension adaptor 352 cannot be coupled to the top end of the extension part 340.

Each component of the extension system is optimized for strength based on the expected bending moment derived by a given side load and the length of the component. Each added component can change the moment on the lowermost components (i.e., the component(s) closer to the ram 76 in the retraction direction 120). For example, when the extension adaptor 352 and the extension part 340 are placed together on the ram 76 (FIG. 30), the lower end of the extension adaptor 352 has a larger size engaging the end surface of the ram 76. The adaptor 352 therefore generates a larger reaction moment (or "righting" moment) to shift at least a portion of the load from the pin 356.

FIGS. 31-34 illustrate another construction of a lift system 1010. The lift system 1010 includes a hydraulic lifting cylinder including a base 1020 (FIG. 33) and an externally threaded plunger or ram 1012 (FIG. 32) received in the base 1020 and extending from one end thereof. The lifting cylinder is supported on a wheeled platform for movement to a location under a load (e.g., a vehicle) to be lifted. A handle attached to the platform facilitates movement of the lift system.

Figure 32:
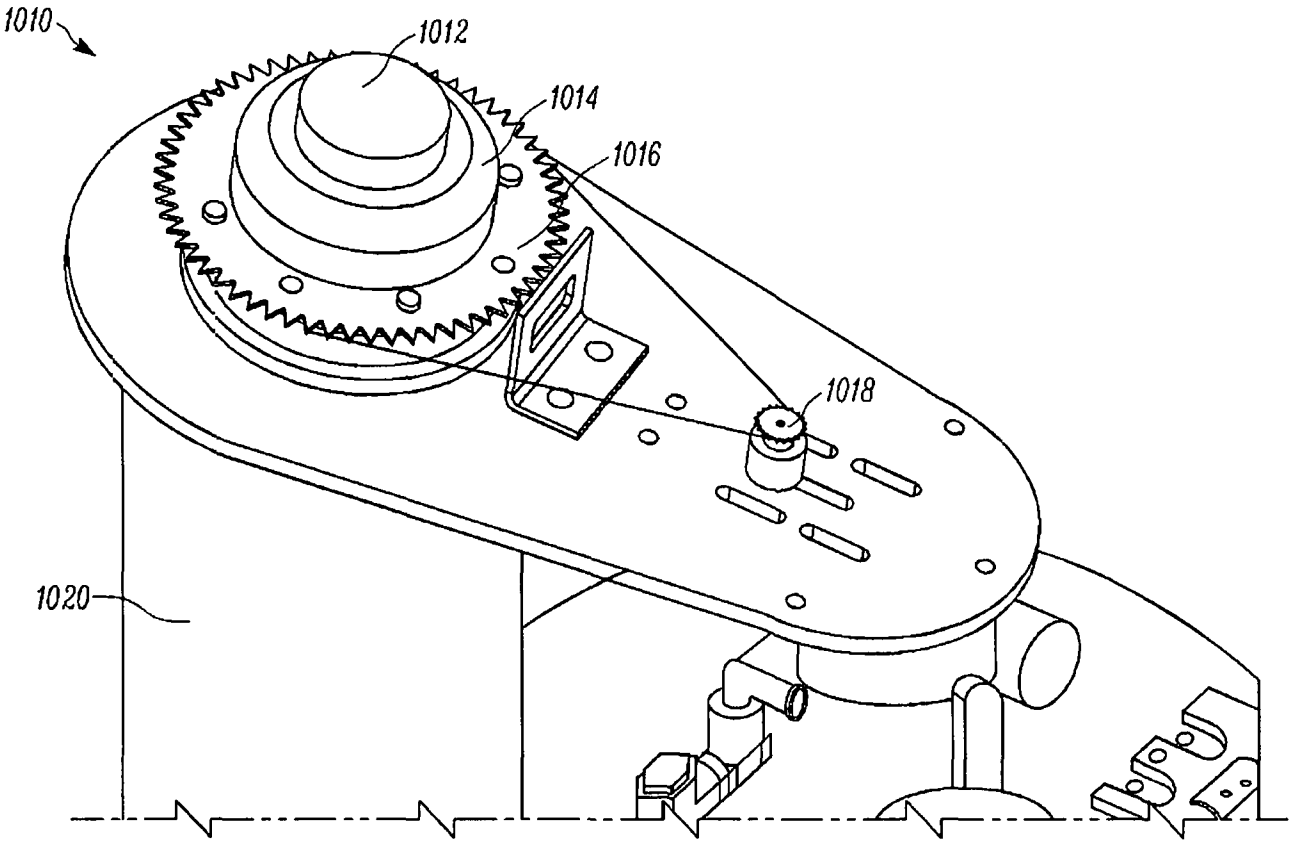
FIG. 32 is an enlarged perspective view of an upper portion of the lift system shown in FIG. 31, with a top cover removed.
Figure 33:
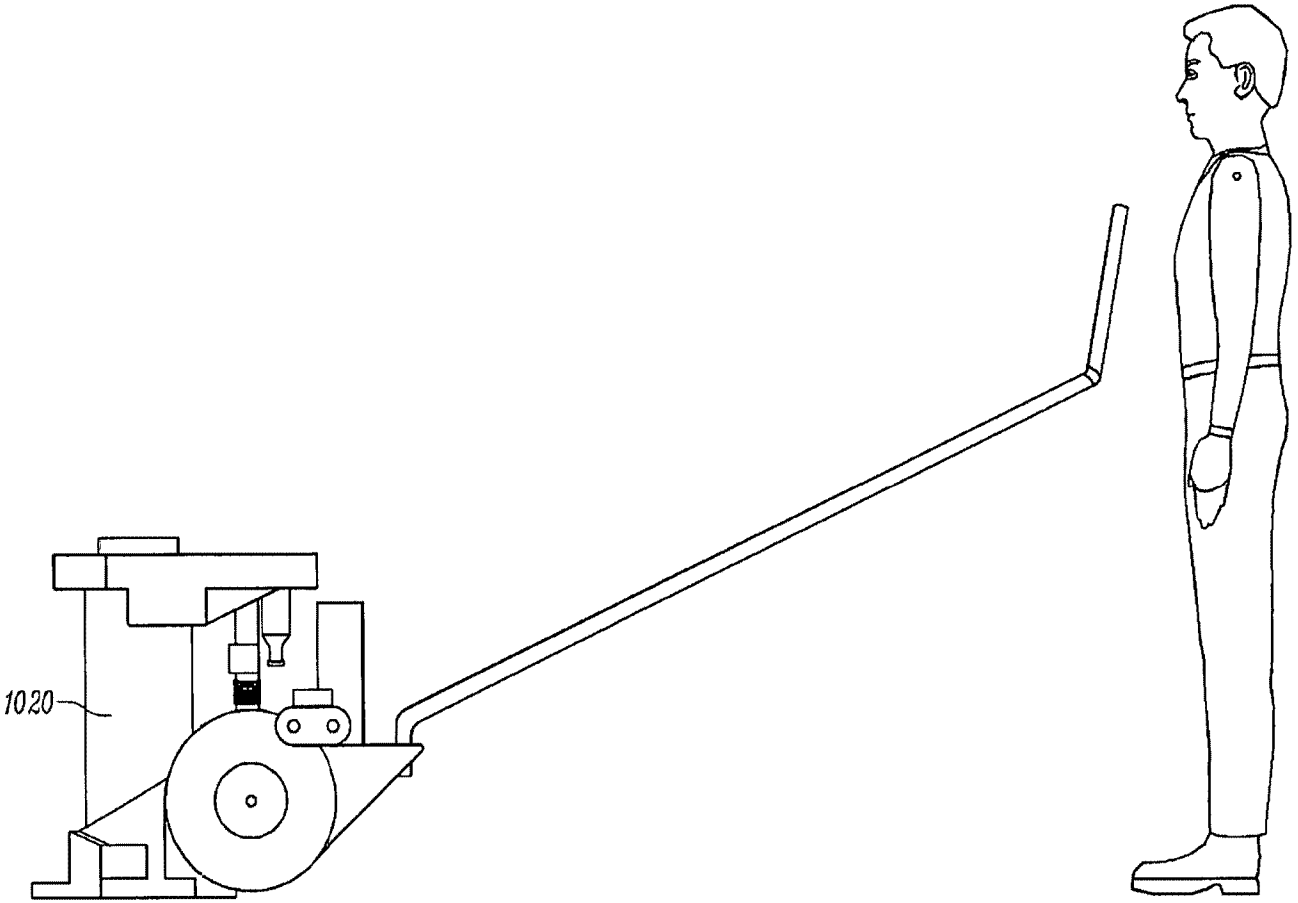
FIG. 33 is a side view of the lift system shown in FIG. 31.
Figure 34:
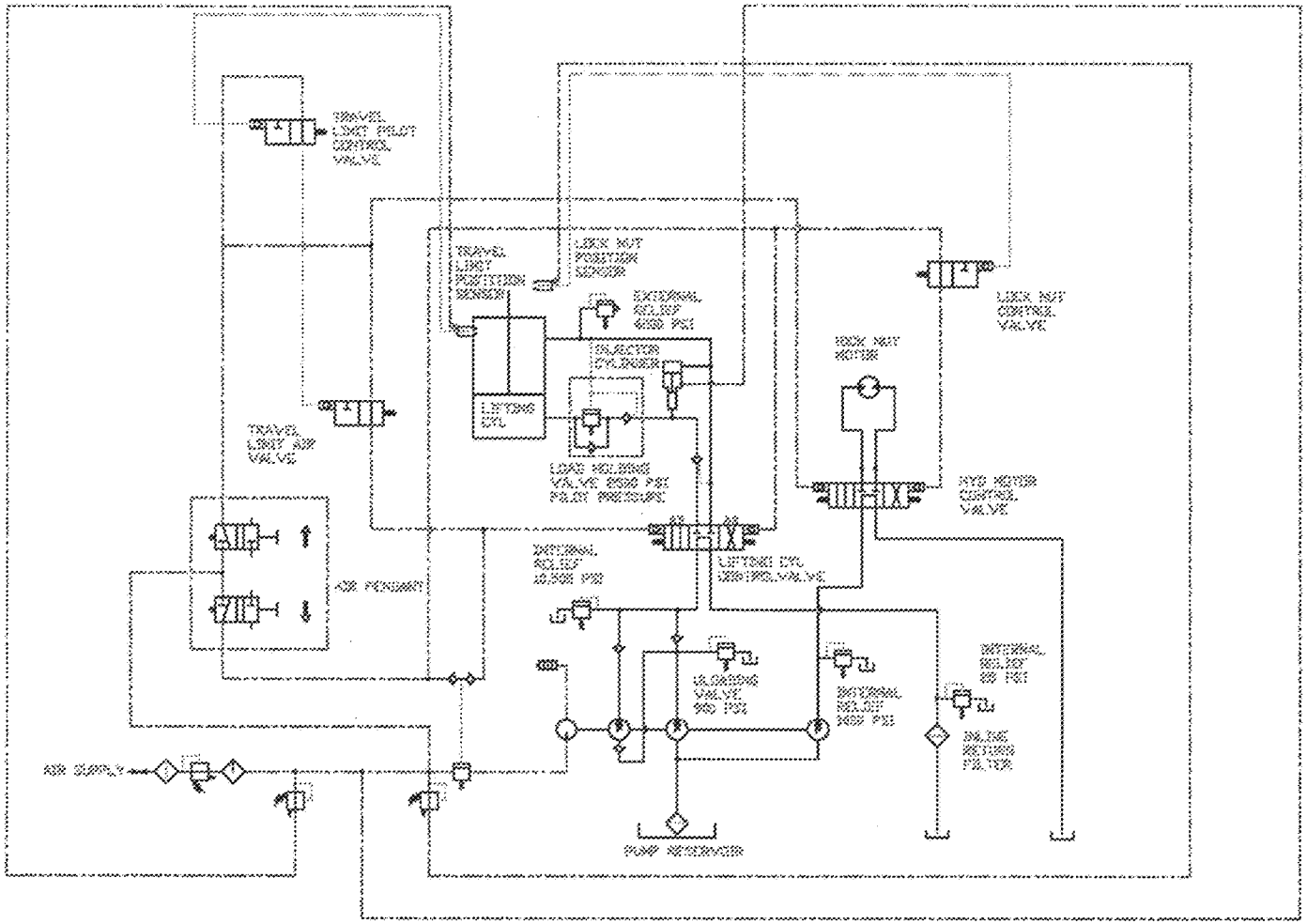
FIG. 34 is a schematic diagram of an operating circuit for a lift system.

As shown in FIG. 32, the lift system 1010 also includes an internally threaded lock nut 1014 rotatably received on the ram 1012, adjacent the one end of the base 1020, and engageable with a support surface (e.g., the end of the base 1020 in the illustrated construction) to selectively prevent retraction of the ram 1012 into the base 1020.

More particularly, when extending the ram 1012 from the base 1020, the locking nut is rotated at a rate faster than extension of the ram 1012, so that the lock nut 1014 engages the end of the base 1020 and further rotation of the lock nut 1014 then stalls. The torque applied to rotate the lock nut 1014 to engage the base 1020 end is insufficient to cause the lock nut 1014 to continue to rotate after lock nut 1014 engages the base 1020, otherwise further rotation of the lock nut 1014 might cause further extension of the ram 1012 from the base 1020.

When the ram 1012 needs to be retracted back into the base 1020, the ram 1012 is first extended a small distance sufficient to cause the lock nut 1014 to no longer engage the end of the base 1020. Then, as the ram 1012 is retracted, the lock nut 1014 is rotated away from the end of the base 1020 so that the lock nut 1014 remains a short distance away from the end of the base 1020.

In addition, during normal lifting, the ram 1012 is prevented from being fully extended. A sufficient amount of further extension remains so that the ram 1012 can be extended enough to cause the lock nut 1014 to no longer engage the end of the base 1020, prior to the ram 1012 being retracted.

Referring to FIG. 32, the lock nut 1014 is driven by a nut hydraulic motor. More particularly, the lock nut 1014 has an external nut spur gear 1016, and the nut hydraulic motor has a driven shaft with a shaft spur gear 1018. In this construction, a chain operably connects the shaft spur gear 1018 and the nut spur gear 1016, and rotation of the shaft spur gear 1018 causes rotation of the nut spur gear 1016. In other constructions (not shown), the shaft spur gear 1018 can directly drive the nut spur gear 1016.

In the operating circuit of the lift system 1010, three hydraulic pumps are provided, all driven off a common power source (e.g., compressed air in the illustrated construction). One pump operates to rotate the lock nut 1014, another pump provides low pressure or first stage or speed lifting operation, and the third pump provides higher pressure or higher load lifting operation. The power source also provides the motive force to operate pneumatic driven pumps and to power an air control circuit, as explained further below. Various relief valves are provided in the operating circuit to ensure proper control of the operating pressures of the operating circuit.

An air pendant is used to control the lift system 1010. One button raises/extends the ram 1012, and another lowers/retracts the ram 1012. The air pendant is powered by the power source operating at about 90 psi, and the pneumatic pump receives air from an air filter regulator and lubricator.

A lifting cylinder control valve controls extension or retraction of the ram 1012. The lifting cylinder control valve is a 3-position, 4-way open center valve that responds to the direction information from the air pendant, to move off of its central or open position, to one that either extends or retracts the ram 1012. Between the lifting cylinder control valve and the lift cylinder, a conventional over center load holding valve is provided, to provide control of the speed of retraction of the ram 1012.

The lock nut pump operates a lock nut motor, via a lock nut motor control valve. The valve is a 3-position, 4-way tandem center valve, which is normally in a centered position that allows the lock nut pump flow to pass through the lock nut motor control valve to tank. The output ports of the lock nut control valve are closed, preventing rotation of the lock nut hydraulic motor. The valve is biased, in response to a pilot pressure, and the direction information from the air pendant, directing flow to the lock nut motor to provide the rotation direction required for the lock nut 1014. During the lifting action of the cylinder, the nut rotates in a direction corresponding to the thread on the ram, to keep the nut in contact with the top of the cylinder. In the construction illustrated, the threads are right hand and the direction of rotation required for the lock nut during the extension of the ram is clockwise. During retraction of the ram, the lock nut 1014 rotates in the opposite direction (i.e., counter clockwise).

The principle operating circuit control, after the air pendant, is provided by two air pressure sensors. Each sensor responds to a blockage in front of the sensor which, in turn, results in a pressure signal from the sensor.

One sensor is located within the base near the top of the base, where normally a clearance is present between the base and the ram. When the end of the ram reaches near the top of the base, a wider diameter section of the ram blocks the sensor. This in turn provides a higher pressure output from the sensor that provides a pilot signal to the travel limit pilot control valve. The travel limit pilot control valve controls the pilot pressure to the travel limit air valve which in turn controls pilot pressure to the extend pilot on the lifting cylinder control valve.

When the travel limit pilot control valve receives a pilot signal from the sensor, the pilot signal to the travel limit valve is interrupted. This removes and vents the pilot signal to the extend pilot on the lifting cylinder control valve, causing the valve to center, which stops further extension of the ram 1012. As a result of stopping further extraction of the ram 1012 from the base 1020 in this position, a clearance is provided between the end of the ram 1012 and the top of the base 1020 so that the ram 1012 can still be lifted (e.g., slightly) prior to being retracted, as further explained below.

The other sensor is located on top of the base 1020, in an area between the base 1020 and the lock nut 1014. The sensor can be any device that is able to provide a signal based on the position of the lock nut 1014 (e.g., a proximity sensor, an air sensor, etc.). When the lock nut 1014 contacts the base 1020, the lock nut 1014 blocks the sensor, thus providing a higher pressure output from the sensor. The sensor directs a pilot signal, via a lock nut control valve, to the lock nut motor control valve that is biased from its normally closed position. This allows flow to the retract pilot of the nut motor control valve.

When the lock nut 1014 is turned counter clockwise, the lock nut 1014 spins away from the base 1020 and uncovers the end of the sensor. When the end of the sensor is uncovered, the pilot signal to the lock nut control valve is lost, causing the lock nut control valve to return to its normally closed position interrupting and venting the pilot signal to the lock nut motor control valve. The lock nut motor control valve centers and stops the flow of fluid to the lock nut motor, stopping the rotation of the lock nut 1014. When the ram 1012 retracts, the now stationary lock nut 1014 lowers until the sensor is covered again which restores the signal and, in turn, restores the pilot pressure to the retract pilot on the lock nut motor control valve.

Another aspect of the lift system 1010 is extending the ram 1012, prior to retraction, to ensure the lock nut 1014 is not in contact with the top of the base 1020 to allow the ram 1012 to be retracted. To this end, an initial flow of hydraulic fluid from the lifting cylinder control valve retract circuit causes fluid to flow to an injector cylinder (sometimes referred to as a pressure intensifier). The fluid flow to the injector results in a measured flow of fluid under pressure being routed to the extend circuit of the lift cylinder which, in turn, causes the temporary raising of the cylinder.

The output of the injector piston is between a pilot operated check valve and the over center valve that provide hydraulic load holding so that the flow displaced by movement of the piston can only add fluid to the lifting cylinder to extend the ram 1012. The ends of the injector piston can have a variable area ratio to each other to provide different relationships of pressure between the extend and retract circuits of the lifting cylinder. As fluid continues to flow into the retract circuit, the pilots that open the pilot check valve and the over center valve are pressurized and biased to open both valves so refraction of the ram 1012 is possible.

The injector piston is reset by pressing the extend button on the air control pendant. The flow of pressurized fluid to lift the ram 1012 moves the injector piston back to its "pre-injection" position and refills the cavity that displaces fluid into the extend cavity of the injector piston circuit.

Figure 35:
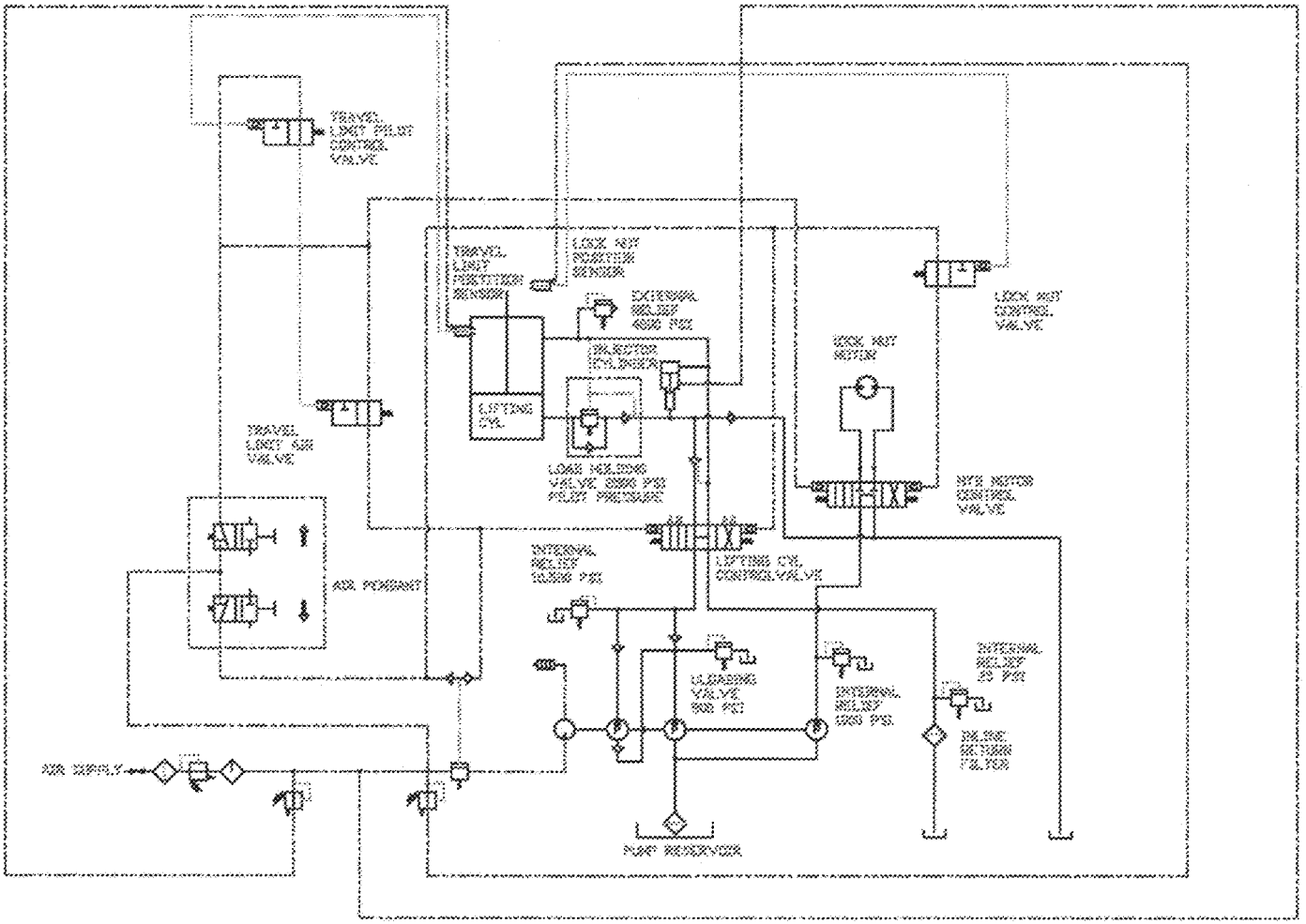
FIG. 35 is a schematic diagram of an alternative construction of an operating circuit for a lift system.

In yet another construction (see FIG. 35), the injector piston has a larger diameter on the retract end, as compared to the end that pushes fluid into the extend side of the lifting cylinder. The two diameters are sealed to produce an area differential across the piston. The difference allows lower pressure to be applied to the retract circuit to cause movement of the injector piston to pump oil into the extend side of the lifting cylinder. The addition of air pressure from the pressure source to the back side of the large end of the injector piston biases the injector piston back to its "pre-injection" position when retract flow and pressure is removed by releasing the retract button on the air control pendant.

A second intake circuit and check valve is on the extend side of the injector piston circuit so that pressing the extend button on the air pendant and extending the lifting cylinder to refill the extend side injector piston cavity is not required. Multiple presses of the retract button will allow the injector piston to cycle and pump fluid into the lifting cylinder extend circuit. This feature may be desirable if some minor loss of pressure on the extend circuit would require more than one cycle on the injector piston to raise the ram, and allow the lock nut 1014 to spin up.

Figure 23A:
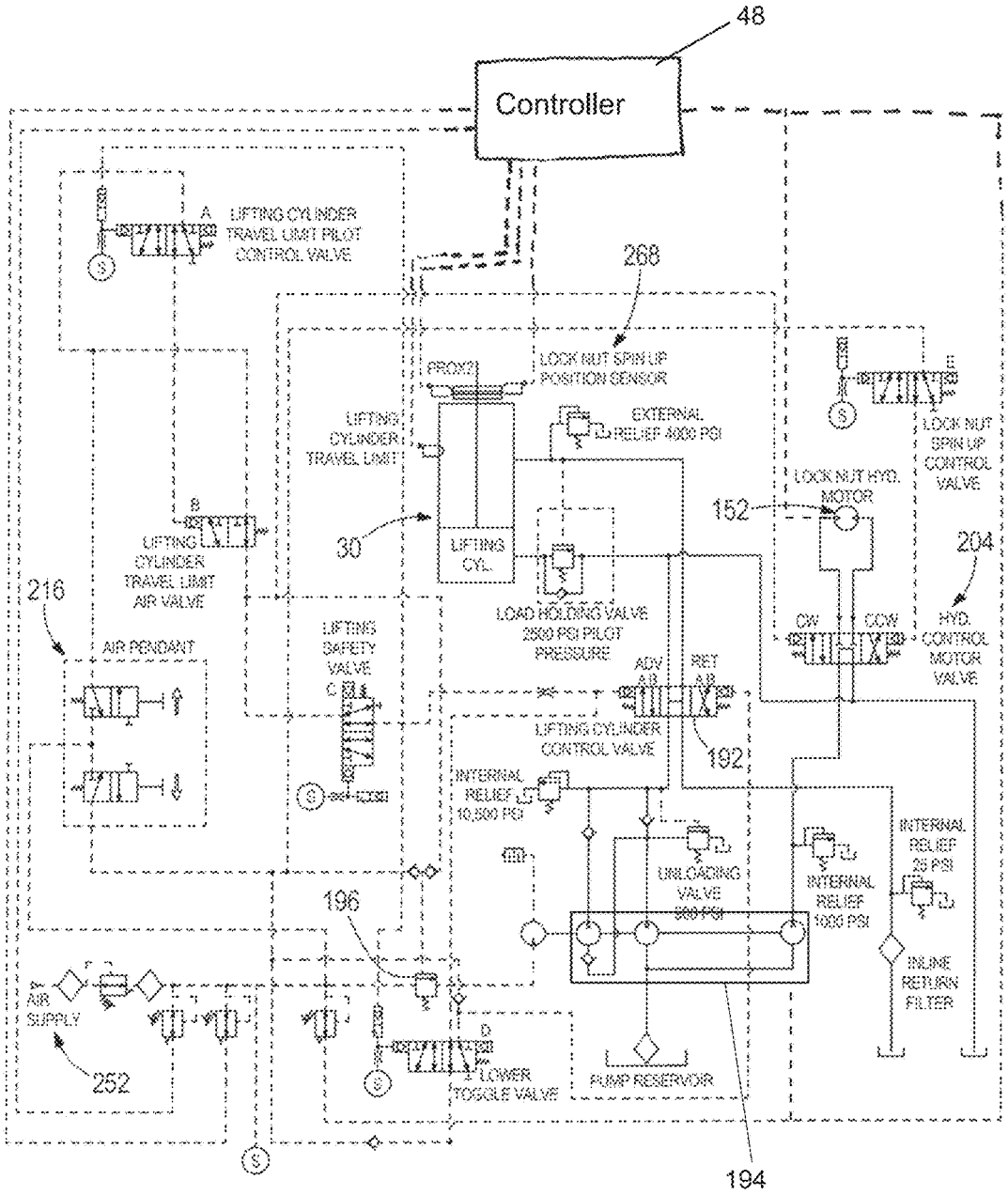
FIG. 23A is a schematic view of a hydraulic and pneumatic system according to another embodiment.
Figure 24:
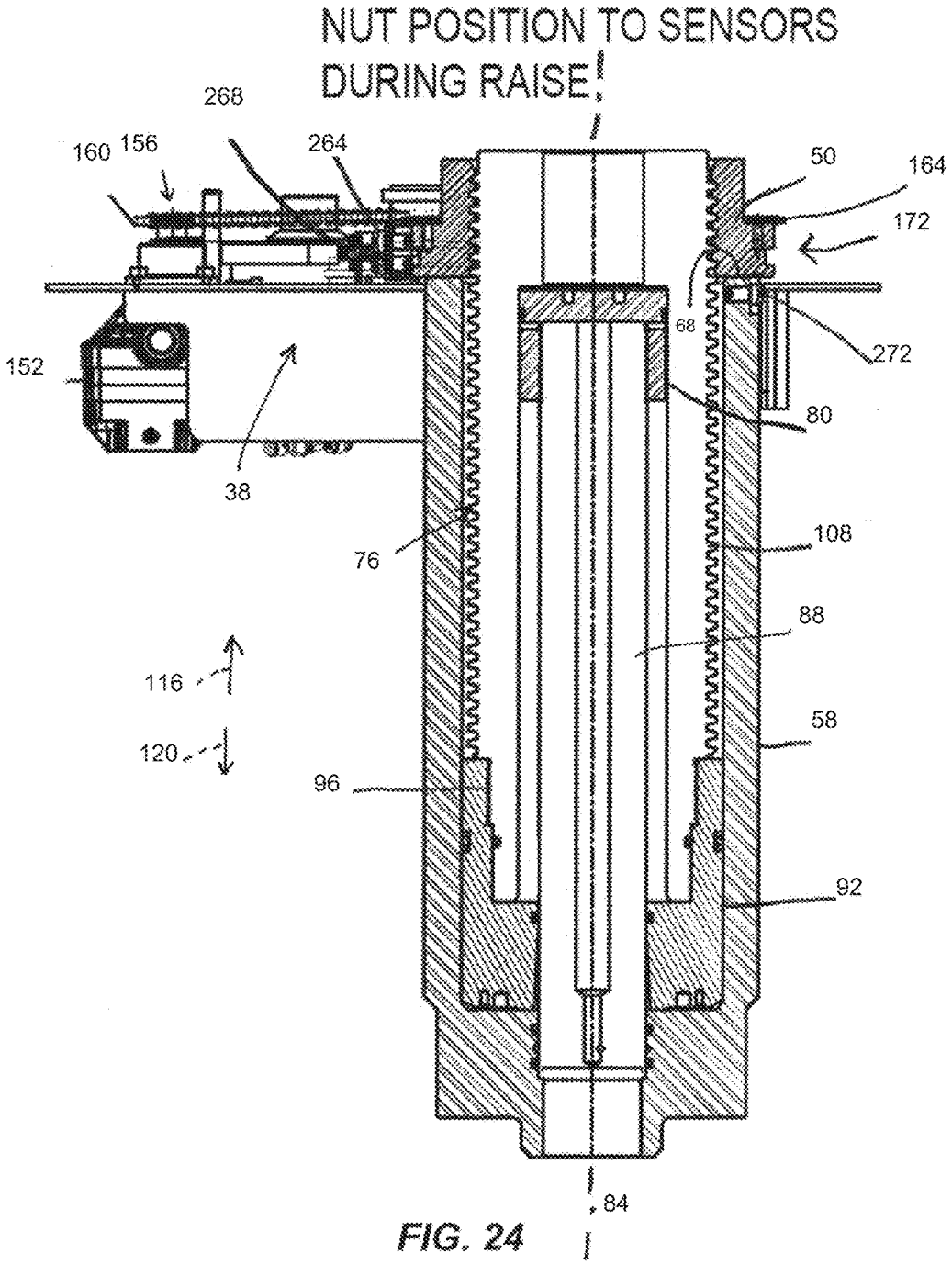
FIG. 24 is a partial cross-sectional view of a lift system with a lock nut in a first position.
Figure 24A:
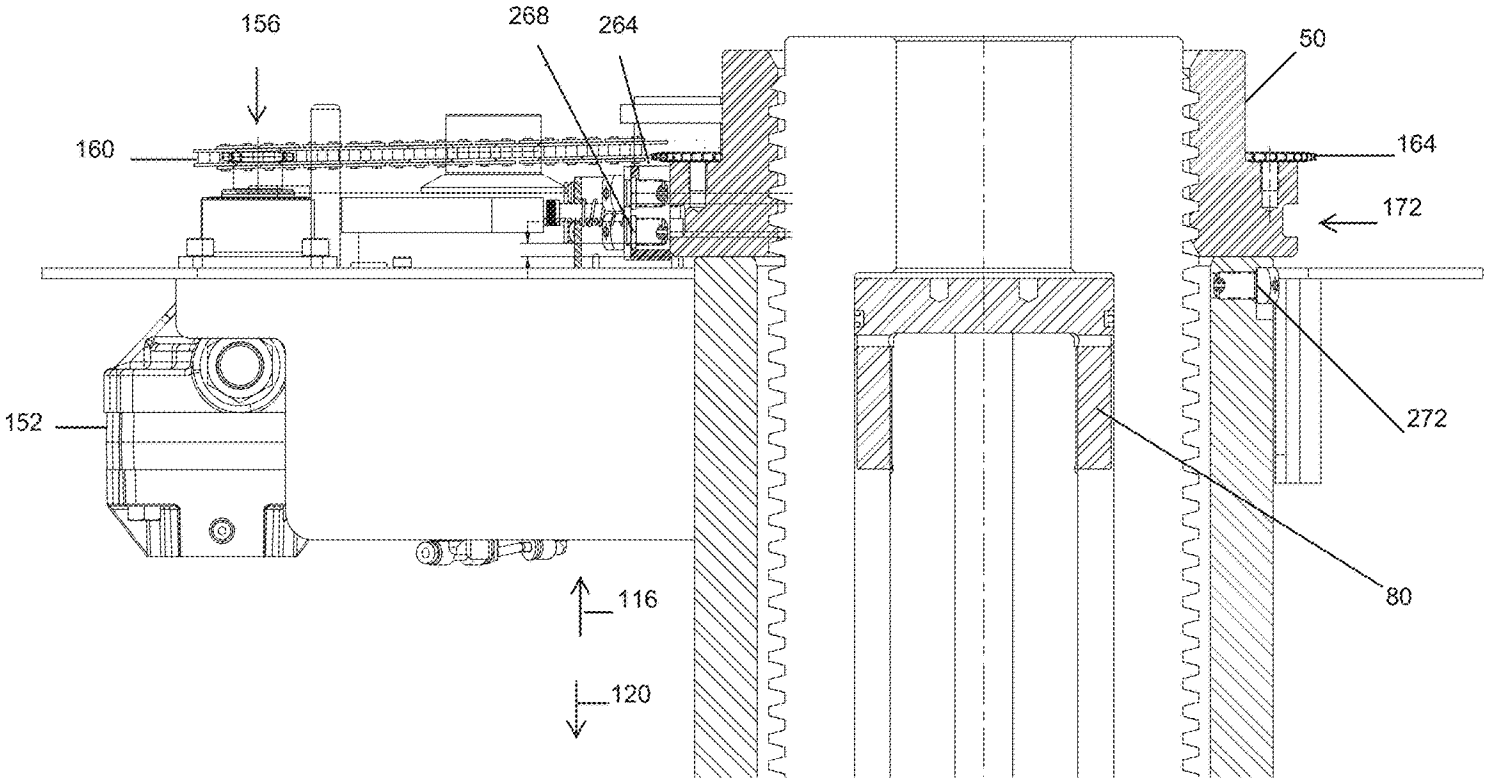
FIG. 24A is an enlarged view of the lift system of FIG. 24.
Figure 25:
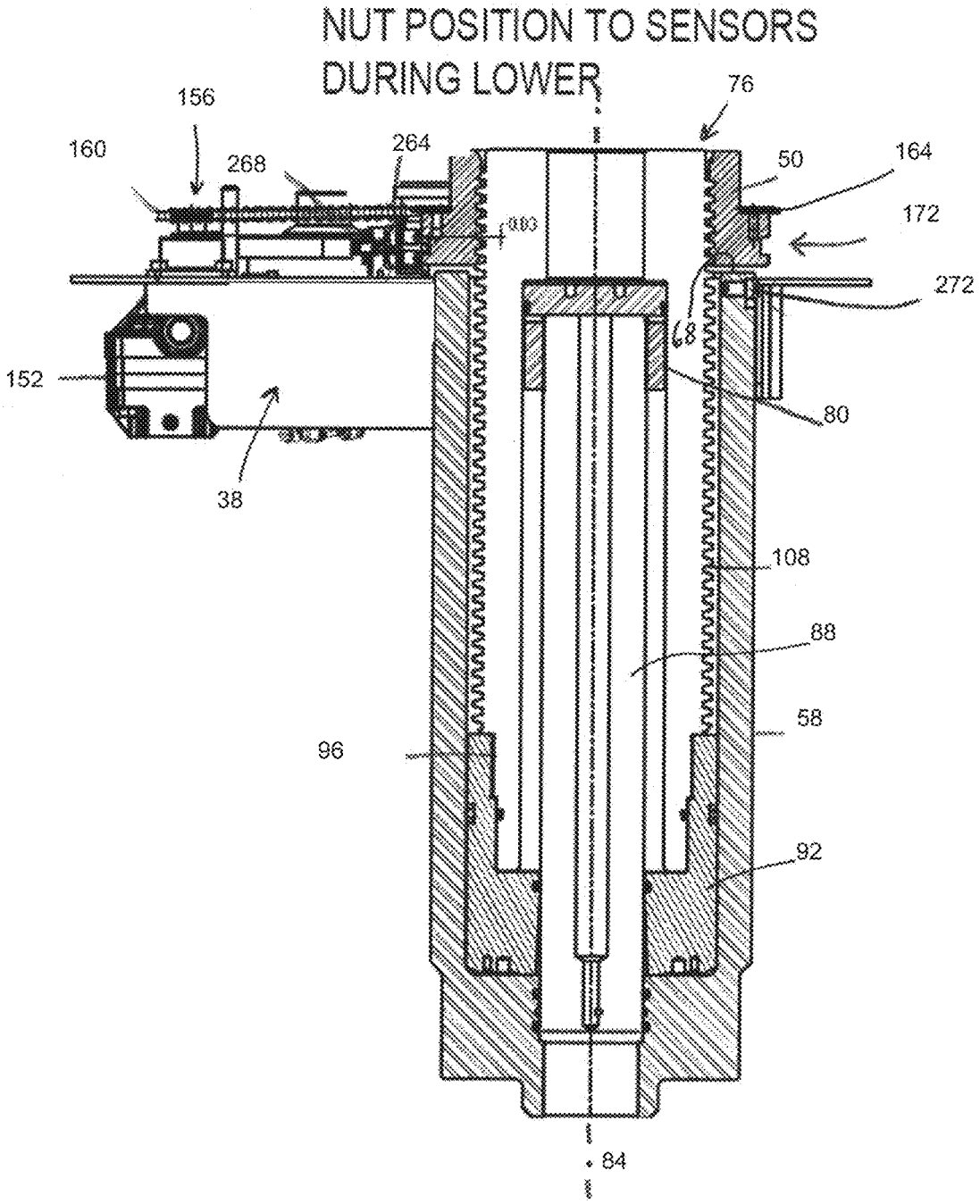
FIG. 25 is a partial cross-sectional view of the lift system with the lock nut in a second position.
Figure 25A:
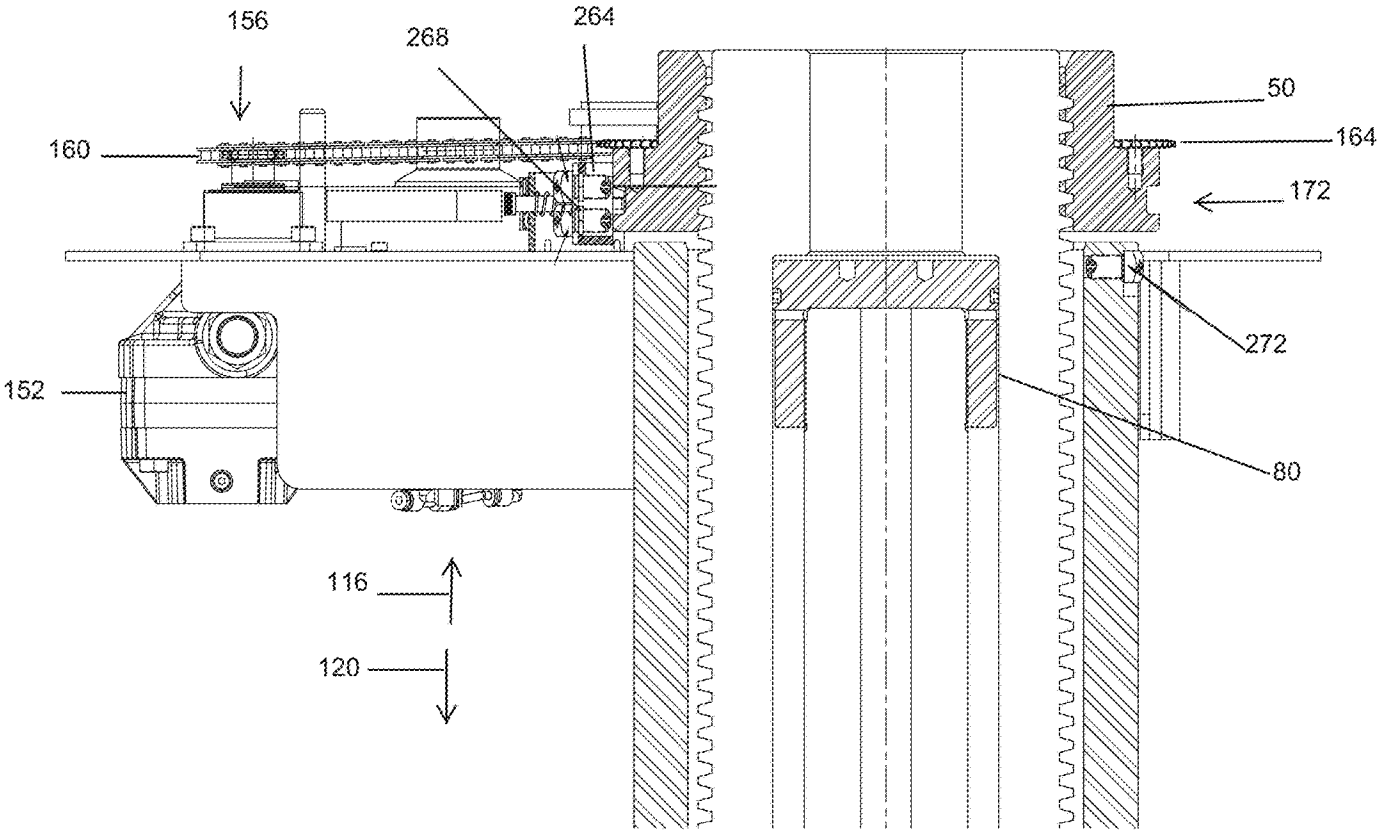
FIG. 25A is an enlarged view of the lift system of FIG. 25.

In alternative constructions, the logic control system 46 may include an electronic control system. The electronic control system may include a controller 48 (FIG. 23A) for operating the fluid pump. The sensors 264, 268, 272 may be in electrical communication with the controller. The top sensor 264 may transmit a signal indicative of the lock nut position, the bottom sensor 268 may transmit a signal indicative of the lock nut position, and the ram sensor 272 may transmit a signal indicative of the ram position. The controller receives the signals from each of the sensors 264, 268, 272 and may initiate or stop movement of the ram 76 and/or initiate or stop operation of the motor 152 in response to these signals. In one embodiment, the controller controls the operation of the ram 76 and the motor 152 by controlling the operation of the three fluid pumps 194.

The controller may include a combination of hardware and software that are operable to, among other things, configure and control operation of the fluid pumps, the ram 76, and/or the motor 152. The controller includes an electronic processing unit (e.g., a microprocessor, a microcontroller, or another suitable programmable device), non-transitory computer-readable media, and an input/output interface. The processing unit, the media, and the input/output interface are connected by one or more control and/or data buses.

The computer-readable media (memory) stores program instructions and data. The memory includes, for example, a program storage area and a data storage area. The program storage area and the data storage area can include combinations of different types of memory, such as read-only memory ("ROM"), random access memory ("RAM") (e.g., dynamic RAM ("DRAM"), synchronous DRAM ("SDRAM"), etc.), electrically erasable programmable read-only memory ("EEPROM"), flash memory, a hard disk, an SD card, or other suitable magnetic, optical, physical, or electronic memory devices.

The processing unit is configured to retrieve instructions from the media and execute the instructions to perform the control processes and methods described herein. The processor is connected to the memory and executes software instructions that are capable of being stored in a RAM of the memory (e.g., during execution), a ROM of the memory (e.g., on a generally permanent basis), or another non-transitory computer readable medium such as another memory or a disc.

Software can be stored in the memory of the controller. The software includes, for example, firmware, one or more applications, program data, filters, rules, one or more program modules, and other executable instructions. The controller is configured to retrieve from memory and execute, among other things, instructions related to the control processes and methods described herein. The controller is also configured to store information on the memory.

The input/output interface transmits data from the controller to external systems, networks, and/or devices and receives data from external systems, networks, and/or devices. The input/output interface stores data received from external sources to the media and/or provides the data to the processing unit.

Many of the modules and logical structures described are capable of being implemented in software executed by a microprocessor or a similar device or of being implemented in hardware using a variety of components including, for example, application specific integrated circuits ("ASICs"). Terms like "controller" and "module" may include or refer to both hardware and/or software. Capitalized terms conform to common practices and help correlate the description with the coding examples, equations, and/or drawings. However, no specific meaning is implied or should be inferred simply due to the use of capitalization. Thus, the claims should not be limited to the specific examples or terminology or to any specific hardware or software implementation or combination of software or hardware.

The independent embodiments described above and illustrated in the figures are presented by way of example only and are not intended as a limitation upon the concepts and principles of the present invention. As such, it will be appreciated that various changes in the elements and their configuration and arrangement are possible without departing from the spirit and scope of the present invention.

Thus, the invention may provide, among other things, a lift system that, throughout the extension and retraction, limits unwanted movement of a load in the event of, for example, a loss of hydraulic pressure. One or more independent advantages and/or independent features of the invention may be set forth in the claims.

What is claimed is:

1. A lift system comprising:

a cylinder having an end surface;

a piston movably supported in the cylinder;

a threaded member supported for movement with the piston;

a nut threadedly engaging the threaded member, the nut being selectively engageable with the end surface, engagement of the nut and the end surface limiting axial movement of the piston relative to the cylinder in at least one direction, the nut defining an outer perimeter and including an external annular groove extending substantially around the outer perimeter;

a drive mechanism including a flexible member operable to rotate the nut relative to the threaded member;

a tension device operable to maintain a predetermined tension in the flexible member;

a control valve operable to control movement of the piston relative to the cylinder;

a drive control mechanism operable to control operation of the drive mechanism and rotation of the nut; and a nut sensor operable to sense a portion of the nut, the nut sensor being in communication with at least one of the control valve and the drive control mechanism, wherein, when the nut sensor detects the portion of the nut, the control valve stops movement of the piston or the drive control mechanism stops rotation of the nut.

2. The lift system of claim 1, further comprising a piston sensor operable to sense an end portion of the piston, the piston sensor being in communication with the control valve to stop extension of the piston when the piston sensor detects the end portion of the piston.

3. The lift system of claim 1, wherein the nut sensor transmits a signal to the drive control mechanism, and wherein, when the nut sensor detects the portion of the nut, the signal is interrupted and the drive control mechanism stops rotation of the nut.

4. The lift system of claim 1, wherein, when the nut engages the end surface of the cylinder, the nut sensor is aligned with the external annular groove and the control valve permits extension of the piston relative to the cylinder.

5. The lift system of claim 1, wherein the portion of the nut is positioned between the external annular groove and the end surface of the cylinder, wherein when the portion of the nut is positioned adjacent the nut sensor, the drive control mechanism stops rotation of the nut.

6. The lift system of claim 5, wherein the nut sensor is a first nut sensor, and wherein the lift system further comprises a second nut sensor operable to sense the nut, wherein, when the annular groove is aligned with the second nut sensor, the nut drive controller stops rotation of the nut when the piston is being retracted.

7. The lift system of claim 6, wherein the portion of the nut is a first portion, the nut further including a second portion, the external annular groove being positioned between the first portion of the nut and the second portion of the nut, and wherein the second nut sensor is aligned with the second portion of the nut when the nut engages the end surface of the cylinder.

8. The lift system of claim 6, wherein the first nut sensor is positioned between the end surface of the cylinder and the second nut sensor.

9. The lift system of claim 1, wherein, during extension and retraction of the piston relative to the cylinder, the nut is driven along the threaded member to alternately abut and be spaced from the end surface of the cylinder.

10. The lift system of claim 1, wherein the control valve is configured to control at least one of a direction and a speed of fluid flow into the cylinder to control movement of the piston relative to the cylinder.

11. The lift system of claim 1, wherein the flexible member is a continuous chain, the chain engaging sprocket teeth coupled to the nut.

12. The lift system of claim 1, wherein the tension device includes at least one roller and a biasing member, the roller engaging a portion of the flexible member, the biasing member biasing the roller into engagement with the flexible member.

13. The lift system of claim 1, wherein the flexible member extends in an endless loop around the nut and a drive member, wherein the drive member rotates about a drive axis, wherein a line extends between the axis of the threaded member and the drive axis, wherein the tension device includes a first tension device engaging a first portion of the flexible member on a first side of the line, and a second tension mechanism engaging a second portion of the flexible member on a second side of the line.

14. A lift system comprising:

a cylinder having an end surface and extending along a cylinder axis;

a piston supported for movement relative to the cylinder along the cylinder axis;

a threaded member supported for movement with the piston;

a nut threadedly engaging the threaded member, at least a portion of the nut being selectively engageable with the end surface, engagement of the nut and the end surface limiting movement of the piston relative to the cylinder along the cylinder axis in at least one direction; and a sensor assembly operable to sense a position of the nut relative to the end surface, the sensor assembly being supported for movement relative to the cylinder in a direction transverse to the cylinder axis.

15. The lift system of claim 14, further comprising a shoe supported for movement relative to the cylinder in the direction transverse to the cylinder axis, and wherein the sensor assembly is coupled to the shoe.

16. The lift system of claim 15, wherein the sensor assembly includes a first sensor and a second sensor, the second sensor being positioned between the end surface and the first sensor.

17. The lift system of claim 15, wherein the shoe is engageable with the nut.

18. The lift system of claim 15, further comprising a biasing member biasing the shoe towards the nut.

19. The lift system of claim 18, wherein, when the threaded member pivots such that the nut moves away from the sensor assembly, the biasing member biases the sensor assembly toward the cylinder axis.

20. The lift system of claim 19, wherein, when the threaded member pivots such that the nut moves towards the sensor assembly, the sensor assembly moves away from the cylinder axis.

* * * * *